US009433268B2

(12) United States Patent
Ma

(10) Patent No.: US 9,433,268 B2
(45) Date of Patent: Sep. 6, 2016

(54) UMBRELLA HAVING A PIVOT JOINT TO PROVIDE ADDITIONAL DEGREES OF FREEDOM OF ORIENTATION OF ITS CANOPY

(71) Applicant: Mark J. S. Ma, Pomona, CA (US)

(72) Inventor: Mark J. S. Ma, Pomona, CA (US)

( * ) Notice: Subject to any disclaimer, the term of this patent is extended or adjusted under 35 U.S.C. 154(b) by 53 days.

(21) Appl. No.: 14/203,541

(22) Filed: Mar. 10, 2014

(65) Prior Publication Data

US 2014/0311537 A1 Oct. 23, 2014

Related U.S. Application Data

(60) Provisional application No. 61/778,281, filed on Mar. 12, 2013.

(51) Int. Cl.
*A45B 17/00* (2006.01)
*A45B 23/00* (2006.01)

(52) U.S. Cl.
CPC ..... *A45B 17/00* (2013.01); *A45B 23/00* (2013.01); *A45B 2017/005* (2013.01); *A45B 2023/0037* (2013.01); *A45B 2023/0056* (2013.01); *A45B 2023/0075* (2013.01)

(58) Field of Classification Search
CPC A45B 25/02; A45B 17/00; A45B 2025/105; A45B 2023/0031; A45B 2023/0037; A45B 23/00; A45B 2017/005
USPC ..... 135/90, 21, 20.3, 20.1
See application file for complete search history.

(56) References Cited

U.S. PATENT DOCUMENTS 5,785,069 A * 7/1998 Glatz ..... A45B 23/00 135/20.1
6,014,980 A * 1/2000 Glatz ..... A45B 17/00 135/20.1
6,321,763 B1 11/2001 Ma
6,588,438 B1 * 7/2003 Steiner ..... A45B 23/00 135/20.1
6,619,306 B2 9/2003 Ma
6,662,815 B2 * 12/2003 Tung ..... A45B 17/00 135/20.1
6,840,253 B2 1/2005 Ma
6,923,193 B2 * 8/2005 Chen ..... A45B 23/00 135/20.1
7,134,442 B2 * 11/2006 Ma ..... A45B 19/04 135/20.1
7,493,909 B2 * 2/2009 Ma ..... A45B 23/00 135/20.1
7,533,680 B2 * 5/2009 Ma ..... A45B 17/00 135/20.1
7,708,022 B2 * 5/2010 Joen-an Ma ..... A45B 23/00 135/20.1
7,866,331 B2 * 1/2011 Glatz ..... A45B 23/00 135/21
7,886,755 B2 * 2/2011 Tung ..... A45B 23/00 135/20.1
8,104,492 B2 * 1/2012 Dan ..... A45B 23/00 135/20.3
8,360,080 B2 * 1/2013 Liu ..... A45B 17/00 135/20.1

* cited by examiner

*Primary Examiner* — Winnie Yip
(74) *Attorney, Agent, or Firm* — Liu & Liu

(57) ABSTRACT

An umbrella having the crown of the canopy coupled to a support structure via a pivot joint that is structured and configured to allow swiveling and/or tilting of the canopy with ease by a user, in more than one plane or with more than one degree of freedom with respect to the support structure. The canopy frame includes a longitudinal central support hub, and the pivot joint is rotatable about a rotation axis, wherein the axis of the canopy support hub makes a fixed or variable non-zero angle with respect to the pivot joint rotation axis. As a result of the angle between the pivot joint rotation axis and the canopy support hub axis. The rotation of the pivot joint causes tilting of the canopy support hub axis, thus tilting the canopy to change its orientation.

19 Claims, 19 Drawing Sheets

UMBRELLA HAVING A PIVOT JOINT TO PROVIDE ADDITIONAL DEGREES OF FREEDOM OF ORIENTATION OF ITS CANOPY

PRIORITY CLAIM

This application claims the priority of U.S. Provisional Patent Application No. 61/778,281 filed on Mar. 12, 2013, which is fully incorporated by reference as if fully set forth herein. All publications noted below are fully incorporated by reference as if fully set forth herein.

BACKGROUND OF THE INVENTION

1. Field of the Invention

The present invention is directed to large size umbrellas, in particular umbrellas of the type having a canopy supported by a post.

2. Description of Related Art

Heretofore, large umbrellas, such as patio umbrellas, had been configured to allow the shade or canopy (e.g., comprising a fabric panel supported by rib frame structure) to be tilted at different angular positions or orientations with respect to a generally vertical support post. By being able to reposition the orientation of the canopy to the post, better coverage of the canopy can be achieved, to better shade the user from the sun (e.g., at different times of the day).

U.S. Pat. No. 6,014,980 to Glatz discloses a free-arm canopy having a side arm cantilevered from a vertical support post, and a canopy hanging from the extended end of the extended side arm. The side arm is rotatable about its axis. However, the Glatz free-arm canopy involves a rather complicated combination of structures to implement movement including rotation of the side arm to change the orientation of the canopy with respect to the support post. A combination of steps are required to manipulate a combination of structures in order to change the orientation of the canopy with respect to a fixed support post. In particular, the long extending side arm that supports the canopy needs to be rotated in order to change the orientation of the canopy. Given the canopy includes a metal frame and heavy fabric material, and the canopy extends from the end of the side arm, the weight of the canopy creates a rather heavy load to be maneuvered by the rotation of the side arm. As can be appreciated, the structure disclosed in the Glatz patent provides poor mechanical leverage for the rotation of the side arm to maneuver the dead weight of the canopy extending at the extended end of the side arm. Consequently, significant effort is required of the user in rotating the long side arm in order to tilt the load of the canopy hanging from the extended end of the side arm. In addition, given the rotation of the side arm, the degree of freedom of orientation of the canopy is limited to an arc about the side arm axis. Further, given the requirement of a rope that runs through the side arm for use to open/close the canopy, range of rotation of the side arm is therefore limited, thus limiting the range of orientations of the canopy. The degree of freedom of orientation of the canopy is thus severely limited.

For example, U.S. Pat. No. 6,840,253 to Ma, the inventor of the present invention, discloses a "side post umbrella" that includes a side arm supported by and cantilevered from a side support post. A shade hangs from the extended end of the side arm. The side arm is rotatable about its axis, thus tilting the shade to change its orientation with respect to the support post. A handle is provided at the supported end of the side arm, which provides improved leverage for the user to rotate the side arm.

There is a further need for a simple, reliable and easy to operate structure that provides better maneuverability and additional degrees of freedom of orientation of the canopy with respect to a support.

SUMMARY OF THE INVENTION

The present invention overcomes the drawbacks in the prior art, by providing a pivot joint for tilting the canopy of an umbrella (e.g., a patio umbrella), which is reliable and easy to operate by a user. In accordance with the present invention, the support hub of a canopy is coupled to a support structure via a pivot joint that is structured and configured to allow swiveling and/or tilting of the canopy with ease by a user, in more than one plane and/or with more than one degree of freedom with respect to the support structure. With the pivot joint of the present invention, the orientation of the canopy (i.e., the direction of the axis of the canopy support hub) can be selectively positioned without requiring rotation of the support structure (e.g., an extending side arm) to which the canopy is coupled via the pivot joint.

In one aspect of the present invention, the canopy has a frame including a support hub (e.g., a crown, and/or a longitudinal central hub which may be in the form of a shaft, such as a runner of the canopy), and the pivot joint is rotatable about a rotation axis, wherein the axis of the canopy support hub makes a fixed or variable tilt angle with respect to the pivot joint rotation axis. As a result of the tilt angle between the pivot joint rotation axis and the canopy support hub axis. The rotation of the pivot joint causes tilting of the canopy support hub axis, thus tilting the canopy to change its orientation.

The extent of the tilt angle between the support hub and the pivot joint rotation axis in the pivot joint depends on one or more of the following considerations: size of the canopy, extent of the opening of the canopy, weight of the canopy, range of orientations of the canopy (i.e., the range of directions of the support hub axis), orientation of the pivot joint rotation axis with respect to the supporting structure (e.g., the side arm to which the pivot joint is supported), position of the side arm, and/or desired application of the umbrella. Generally, such tilt angle can be less than greater than 0 degrees to about 45 degrees.

In one embodiment, the canopy support hub makes a fixed, non-zero tilt angle with respect to the pivot joint rotation axis. In one embodiment, the canopy rotates along with rotation of the pivot joint. In another embodiment, the canopy support hub make a variable tilt angle with respect to the pivot joint rotation axis. The canopy may or may not rotate along with the rotation of the pivot joint.

In one embodiment, the umbrella comprises a base supporting an upwardly (e.g., vertical or at an angle to the vertical) extending post (e.g., straight or curved). An arm extends at an angle and in a cantilevered manner from the post. The canopy is supported at or near the extended end of the arm, with the support hub of the canopy coupled to the arm via a pivot joint in accordance with the present invention. In one embodiment, the arm may be supported by a cantilever support that is slidable along the post. In addition, one or more support links may be provided between the arm and the post to improve stability of the extending arm. The canopy includes a collapsible frame (including a framework of long and short ribs and/or runners), and a flexible panel (e.g., made of a heavy fabric such as canvas) supported by such frame. The shade can be open to provide shading or closed for storage, by manipulating the frame. The canopy may be symmetrical about the center support hub of the canopy.

BRIEF DESCRIPTION OF THE DRAWINGS

For a fuller understanding of the nature and advantages of the invention, as well as the preferred mode of use, reference should be made to the following detailed description read in conjunction with the accompanying drawings. In the following drawings, like reference numerals designate like or similar parts throughout the drawings.

DETAILED DESCRIPTION OF THE PREFERRED EMBODIMENTS

This invention is described below in reference to various embodiments with reference to the figures. While this invention is described in terms of the best mode for achieving this invention's objectives, it will be appreciated by those skilled in the art that variations may be accomplished in view of these teachings without deviating from the spirit or scope of the invention.

The present invention overcomes the drawbacks in the prior art, by providing a pivot joint for tilting the canopy of an umbrella (e.g., a patio umbrella), which is reliable and easy to operate by a user. In accordance with the present invention, the support hub of a canopy is coupled to a support structure via a pivot joint that is structured and configured to allow swiveling and/or tilting of the canopy with ease by a user, in more than one plane and/or with more than one degree of freedom with respect to the support structure. With the pivot joint of the present invention, the orientation of the canopy (i.e., the direction of the axis of the canopy support hub) can be selectively positioned without requiring rotation of the support structure (e.g., an extending side arm) to which the canopy is coupled via the pivot joint. The orientation of the canopy is generally the direction at which the axis of the canopy support hub is pointed.

The present invention will be described herein-below in reference to umbrellas of the type designed and structured for use to provide shade to a relatively large area, such as in a garden or patio area. This type of umbrellas are generally referred to as patio umbrellas. However it is understood that the present invention could be applied to umbrellas for other applications, currently known or future discovered, without departing from the scope and spirit of the present invention.

Figure 1:
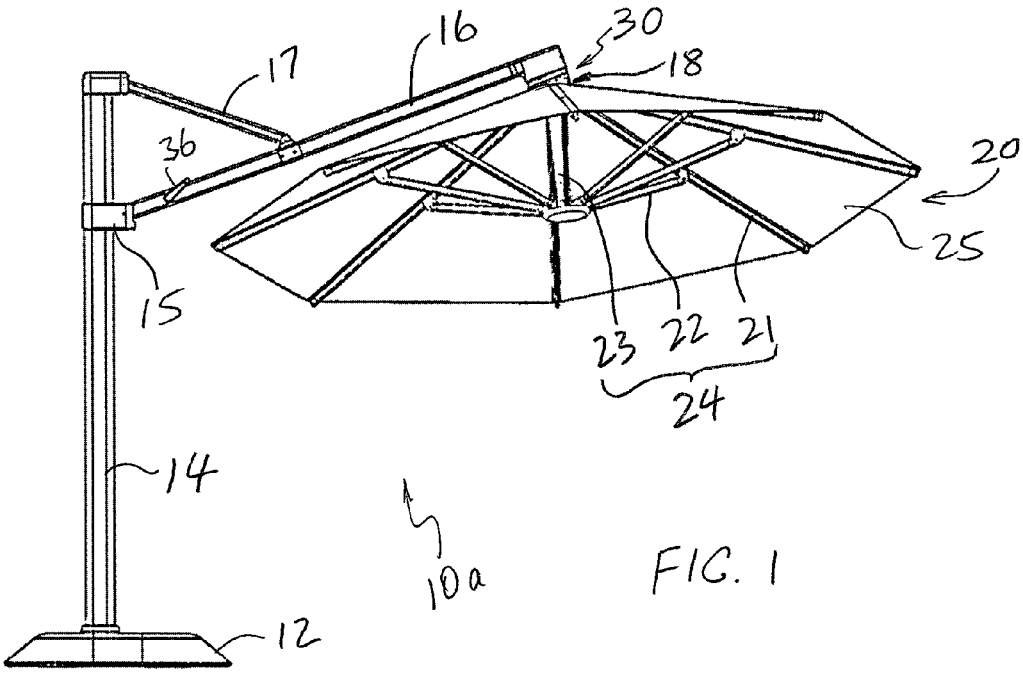
FIG. 1 is a perspective view illustrating a patio umbrella having a pivot joint in accordance with one embodiment of the present invention.
Figure 2:
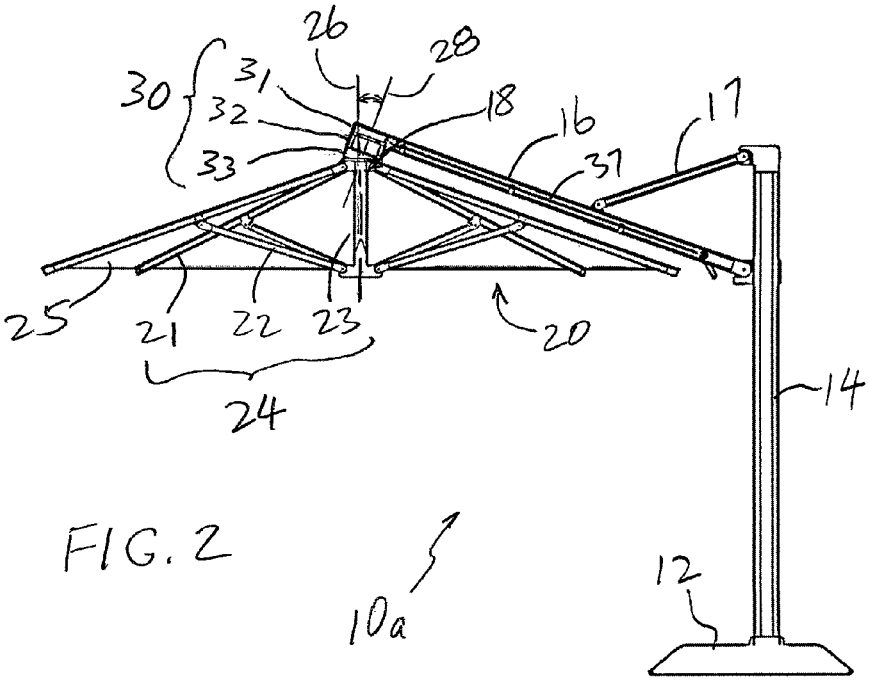
FIG. 2 is a sectional view of the patio umbrella in FIG. 1.
Figure 3:
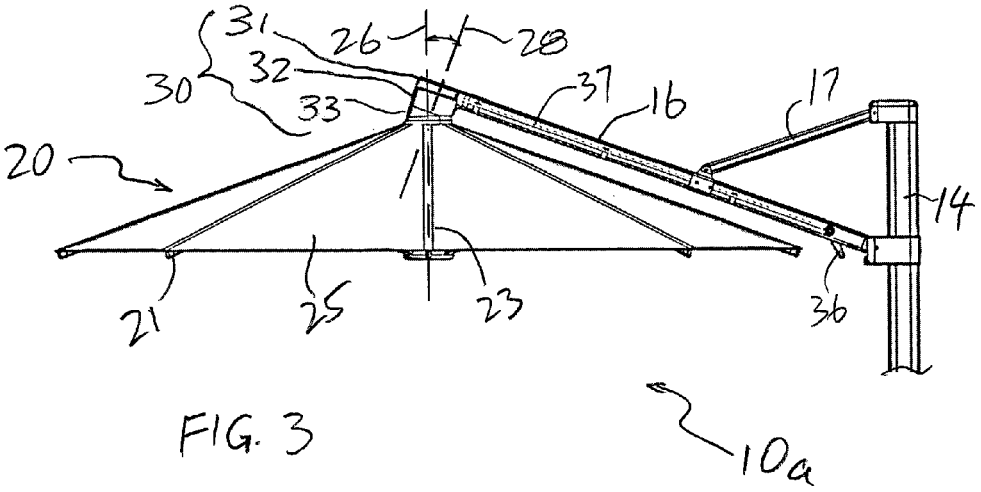
FIG. 3 is a side view of the patio umbrella in FIG. 1.

FIG. 1 is a perspective view illustrating a patio umbrella having a pivot joint in accordance with one embodiment of the present invention. FIG. 1 also is a general illustration of some of the components of a patio umbrella in accordance with one embodiment of the present invention. The illustrated general structure of the patio umbrella is also applicable to other embodiments of the invention discussed herein below.

In the illustrated embodiment, the umbrella 10*a* generally comprises a base 12 supporting an upwardly (e.g., vertical or at an angle to the vertical) extending post 14 (e.g., straight or curved). An arm 16 extends at an angle and in a cantilevered manner from the post 14. The canopy 20 is supported at or near the extended end of the arm 16, with the crown 18 at the apex region of the canopy 20 (i.e., the canopy support hub in this embodiment) pivotally coupled to the arm 16 via a rotatable pivot joint (as further elaborated below in connection with various embodiments) in accordance with the present invention. In one embodiment, the non-extended end of the arm 16 may be hingedly or pivotally supported by a cantilever support 15, which position may be adjusted along the post 14 (e.g., the cantilever support 15 is slidable along the post 14). In addition, one or more support links 17 may be provided between and hingedly or pivotally coupled to the arm 16 and the post 14 to improve stability of the extending arm 16. The canopy 20 generally includes a collapsible frame 24 (which may include a framework of long ribs 21, short ribs 22, and a support hub, such as a runner 23), and a shade 25 comprising a flexible panel (e.g., made of a heavy fabric such as canvas) supported by such frame 24. The shade 25 can be opened (as in the state illustrated in FIG. 1) to provide shading, or closed for storage, by manipulating the frame 24. The canopy frame 24 may be symmetrical about the axis of the canopy's longitudinal central support hub (which may be the runner in some embodiments), which is generally aligned with the pivot joint at the crown of the canopy, and generally to the center of mass or gravity of the canopy 24.

In one embodiment, the canopy support hub makes a fixed, non-zero tilt angle with respect to the pivot joint rotation axis. The canopy rotates along with rotation of the pivot joint. As a result of the fixed angle between the pivot joint rotation axis and the canopy support hub axis. The rotation of the pivot joint causes tilting of the canopy support hub axis, thus tilting the canopy to change its orientation.

In particular, in the embodiment of FIGS. 2-6, the pivot joint 30 rotates about an axis 28, which in this embodiment is a fixed axis in reference to the supporting arm 16. In accordance with the illustrated embodiment, the crown 18 of the canopy 25 is attached to the pivot joint 30, so that it rotates along with rotation of the pivot joint 30. The canopy support hub axis 26 makes a fixed, non-zero tilt angle with respect to the pivot joint rotation axis 28.

Figure 4:
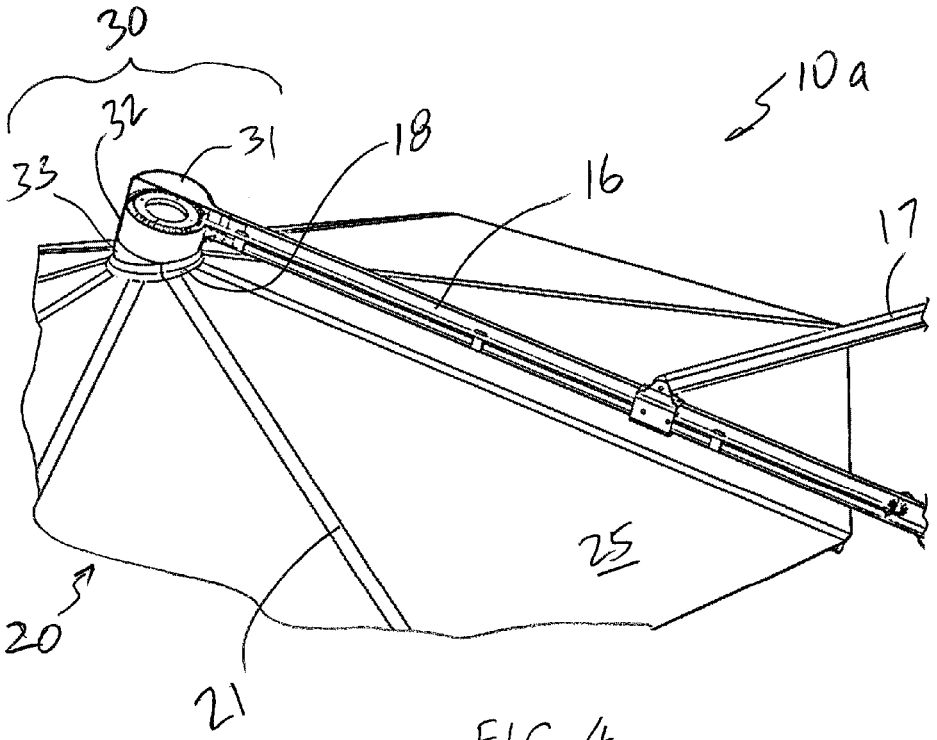
FIG. 4 is an exposed perspective view illustrating a canopy having a pivot joint in accordance with one embodiment of the present invention.
Figure 5:
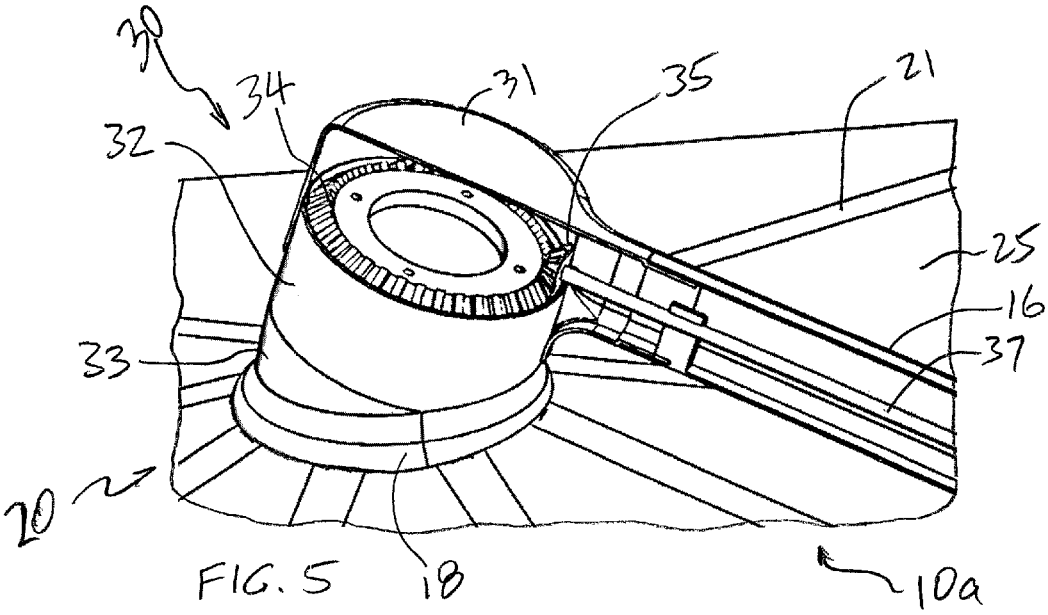
FIG. 5 is an enlarged perspective view of the pivot joint of FIG. 4.

In the illustrated embodiment, the rotatable pivot joint 30 is supported to rotate in a joint housing 31 (more clearly shown in FIGS. 4 and 5). In the illustrations, the rotatable pivot joint 30 is generally cylindrical, but may take on any shape without departing from the scope and spirit of the present invention. To facilitate rotation, support bearings 32 (e.g., roller bearings; which may share similar structure as the support bearing assemblies shown in embodiment of FIG. 12A and FIG. 15C) are provided in the housing to rotatably support the pivot joint 30, to facilitate its rotation with respect to the external housing 31. As shown in the drawings, the rotatable pivot joint 30 supports the canopy in a manner such that the pivot joint rotation axis 28 makes a non-zero tilt angle with respect to the canopy support hub axis 26. In other words, the pivot joint rotation axis 28 is not in line with and/or not parallel to the canopy support hub axis 26. In the illustrated embodiment, this fixed tilt angle is predetermined, defined and fixed by the wedge-shape interface structure 33 between the pivot joint 30 and the canopy crown 18.

Figure 7A:
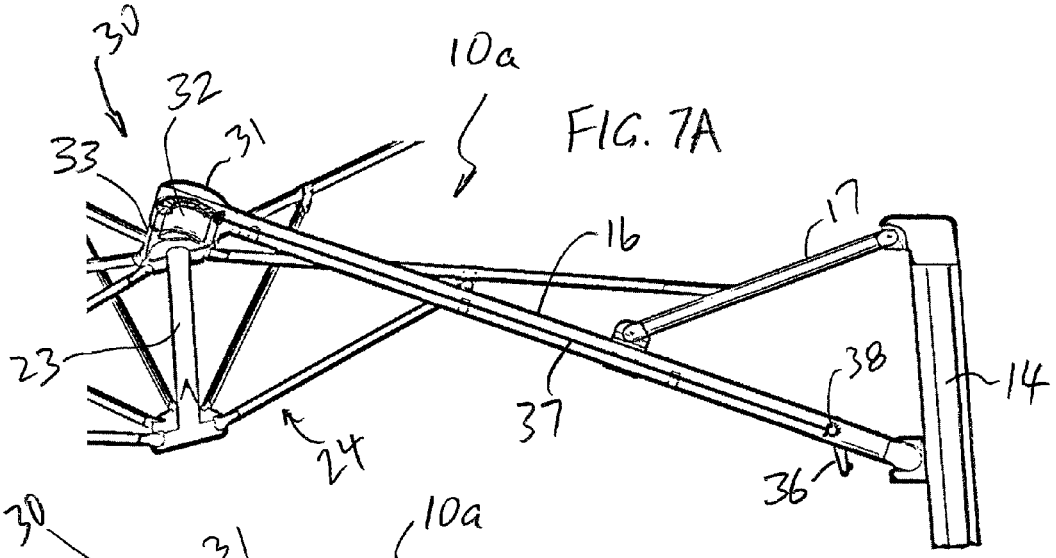
FIGS. 7A-7C are sectional views illustrating the orientations of the canopy frame with rotation of the pivot joint of the embodiment of FIG. 4.
Figure 7B:
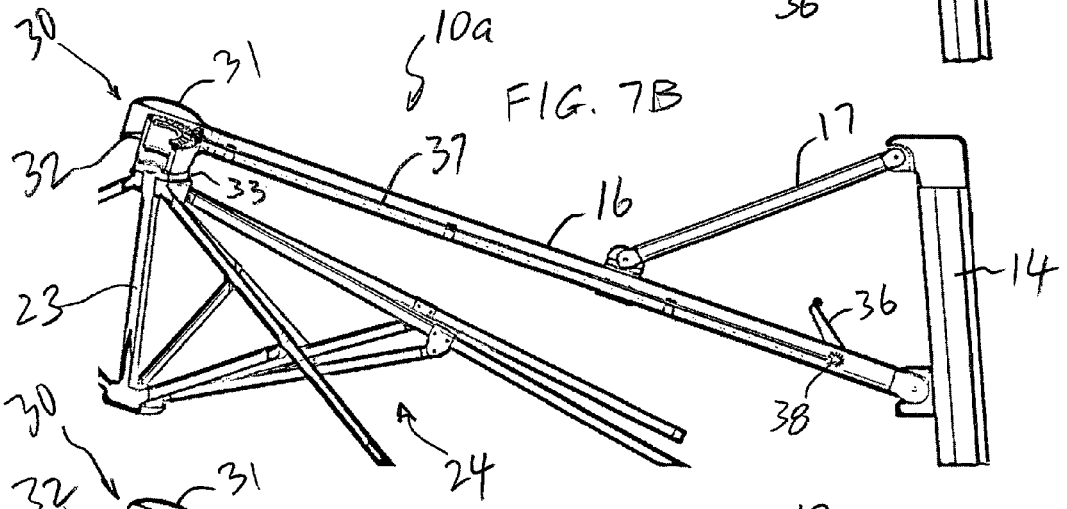
Figure 7C:
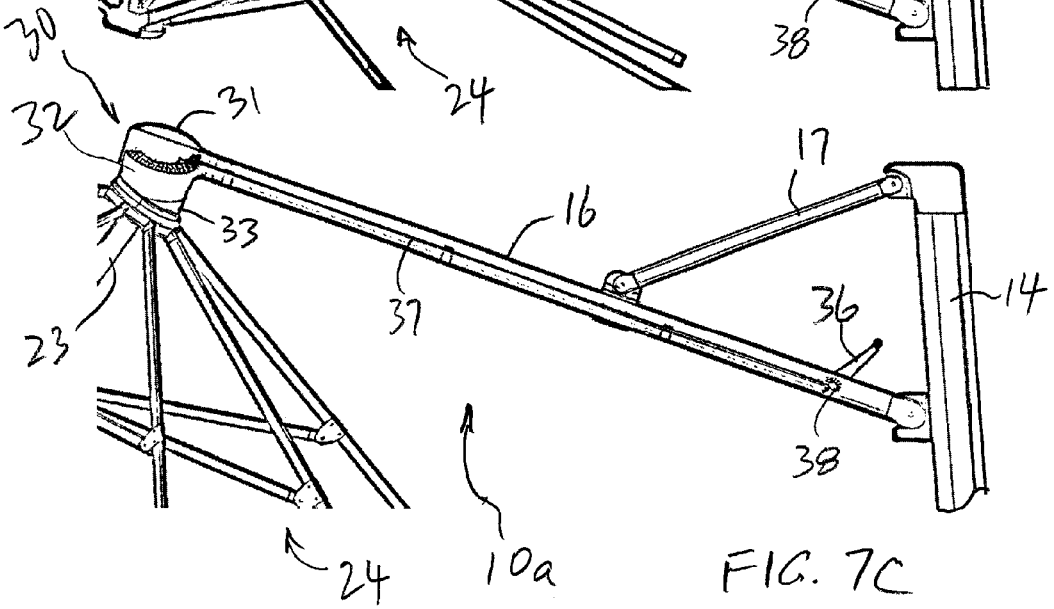
Figure 8A:
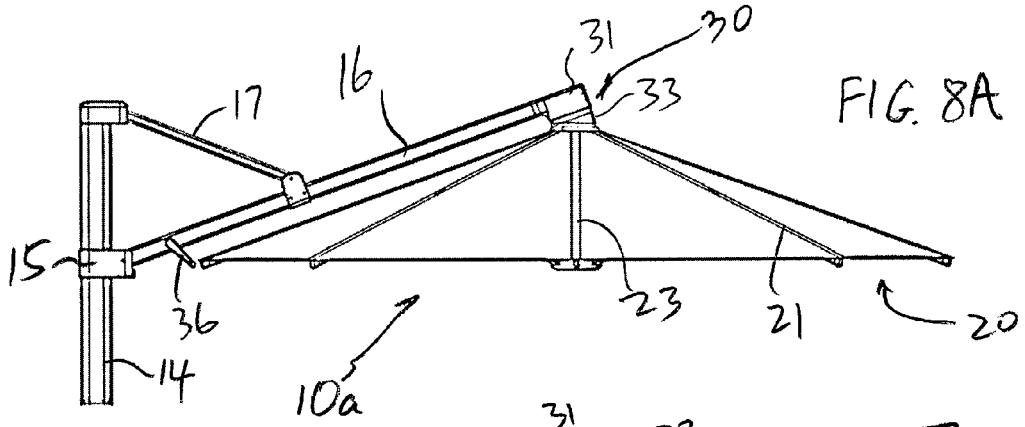
FIGS. 8A-8F are perspective views illustrating the canopy at a series of orientations with rotation of the pivot joint of the embodiment of FIG. 4.
Figure 8B:
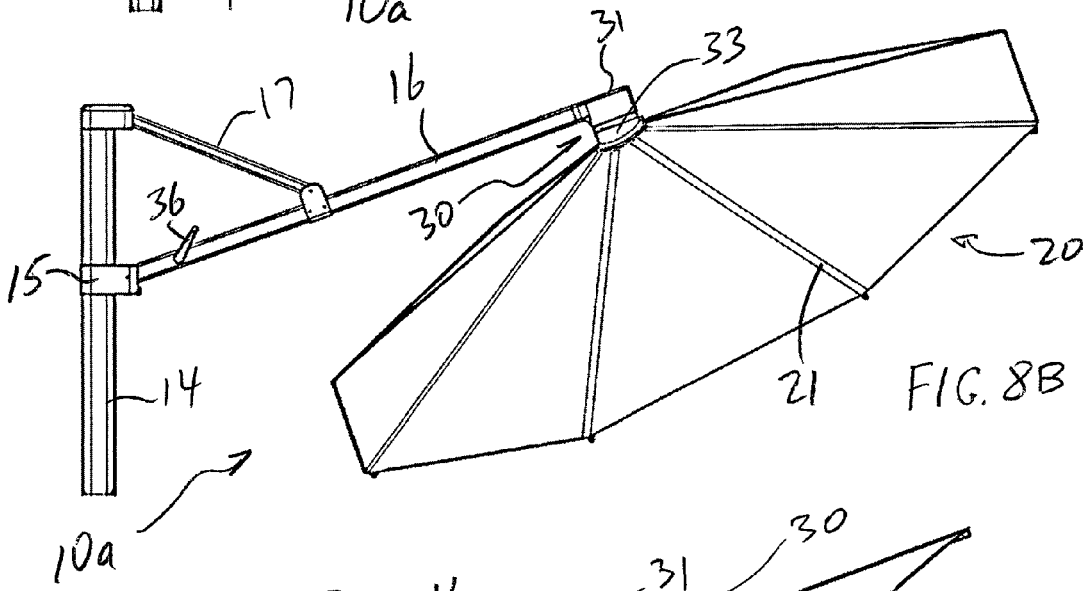
Figure 8C:
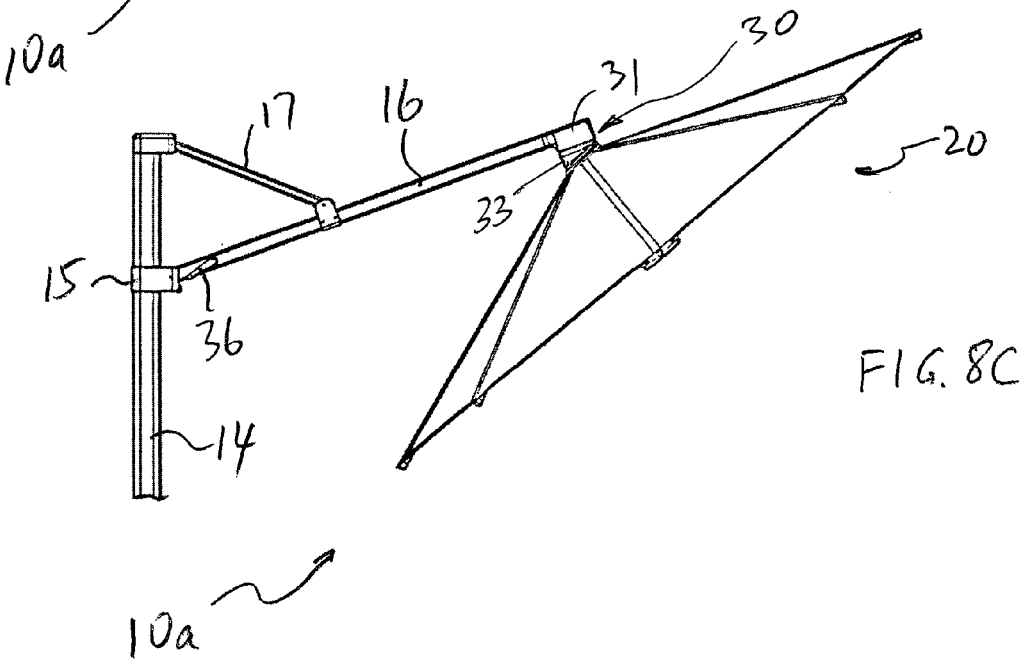
Figure 8D:
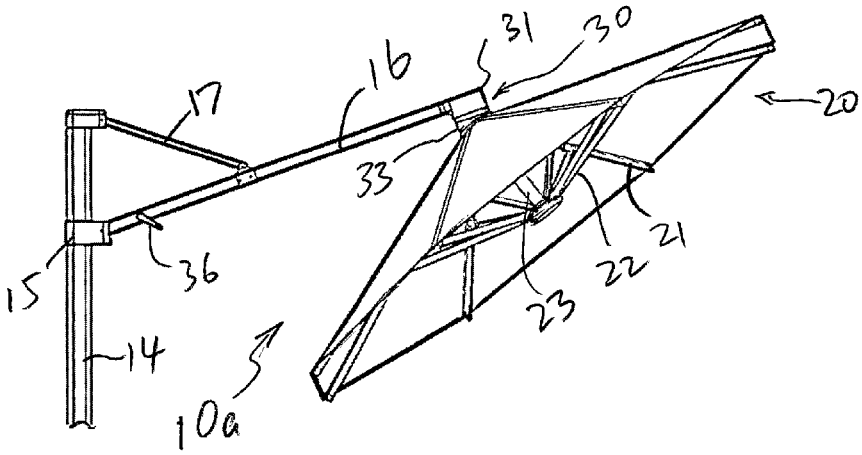
Figure 8E:
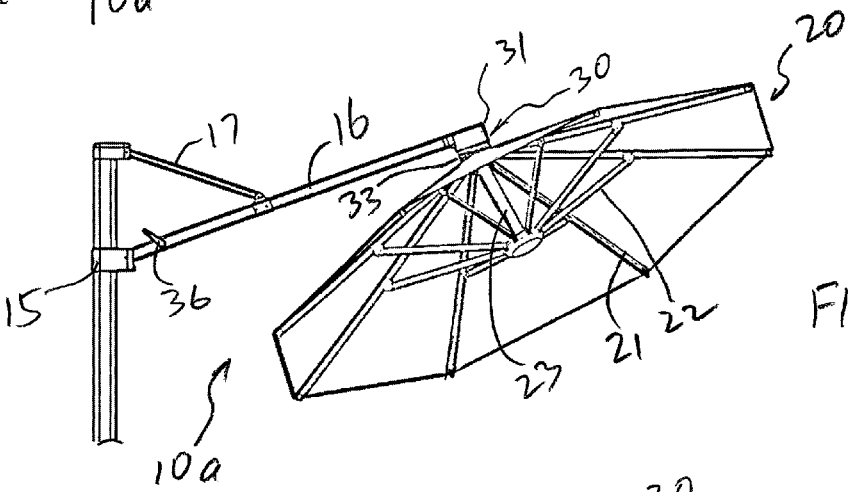
Figure 8F:
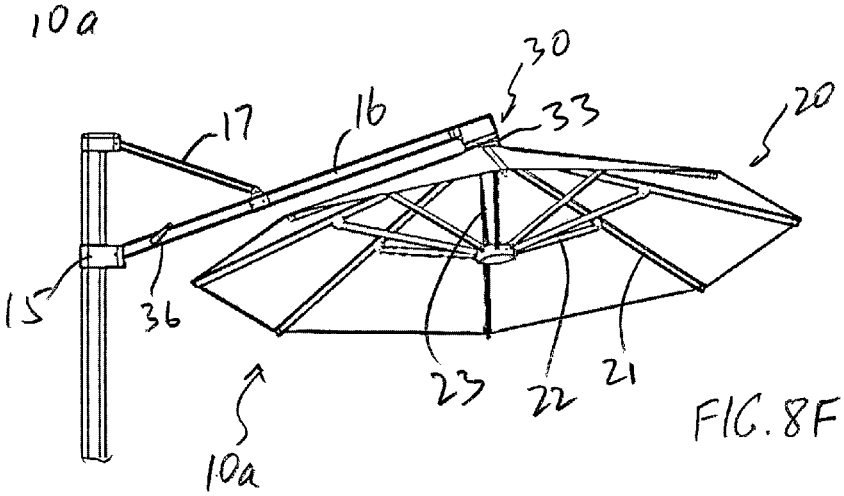

As can be appreciated from the drawings, given the tilt angle between the pivot joint rotation axis 28 and the canopy support hub axis 26, as the pivot joint 30 rotates about its axis 28, the canopy 20 is rotated along with the rotation of the pivot joint 30, thus causing the canopy support hub axis 26 to tilt (in particular, the axis 26 rotates about axis 30, prescribing a path corresponding to the surface of a cone with axis 28). As a result, the canopy 20 changes its orientation with respect to the supporting arm 16, as more clearly shown in the various orientations illustrated in FIGS. 7A to 7C (the shade is omitted from view, so as to more clearly show the relative position of the canopy frame 24 to the arm 16). FIGS. 8A-8F are perspective views illustrating the canopy 20 at various orientations with rotation of the pivot joint 30.

Accordingly, unlike the prior art configurations, the orientation of the canopy 20 can be changed without requiring rotation of the supporting arm 16 from which the canopy 20 is supported at its extended end. Further, unlike the prior art, the orientation of the canopy 20 can vary in more than one plane and/or with more than one degree of freedom with respect to the support arm 16, given that the axis 26 can be essentially swiveled in space, not confined to movement within a particular plane.

Figure 6:
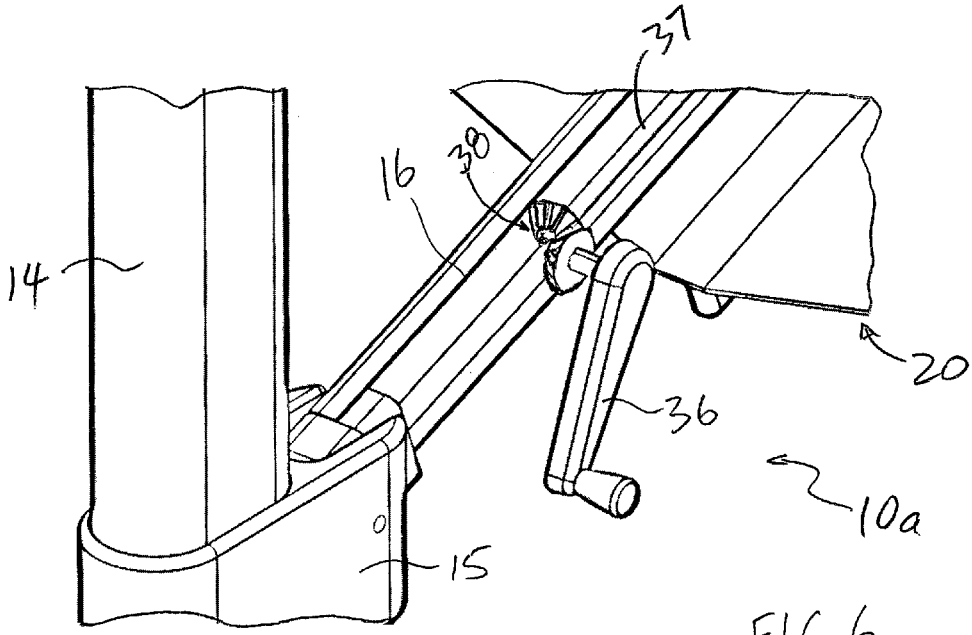
FIG. 6 is perspective view illustrating the crank handle end of the gear drive, in accordance with one embodiment of the present invention.
Figure 11A:
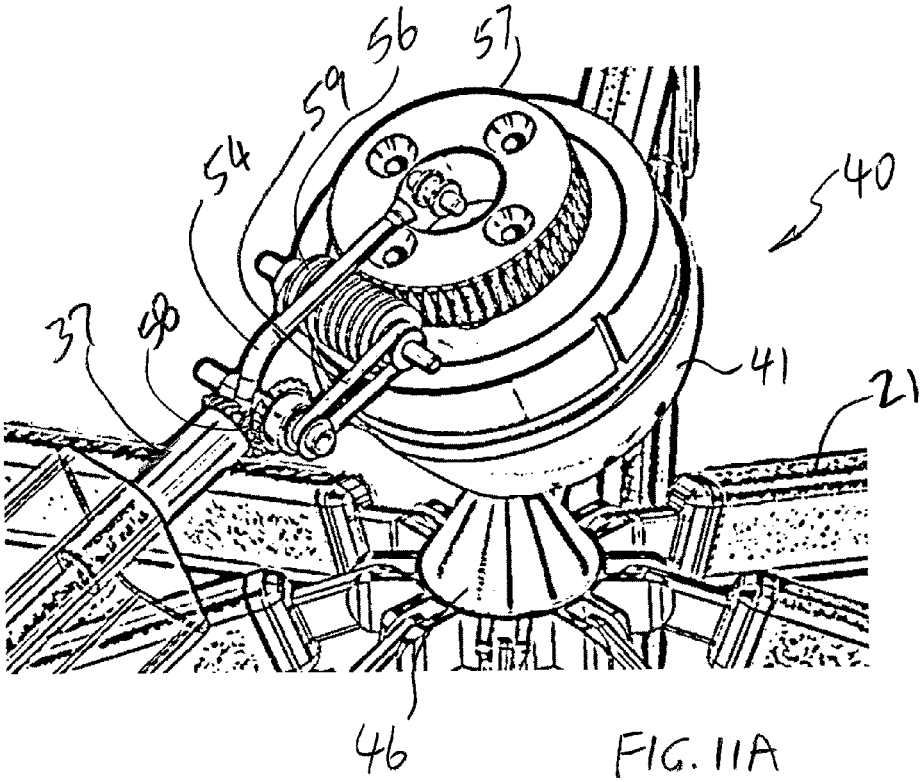
FIG. 11A is an enlarged view illustrating the pivot joint of the embodiment of FIG. 10.
Figure 11B:
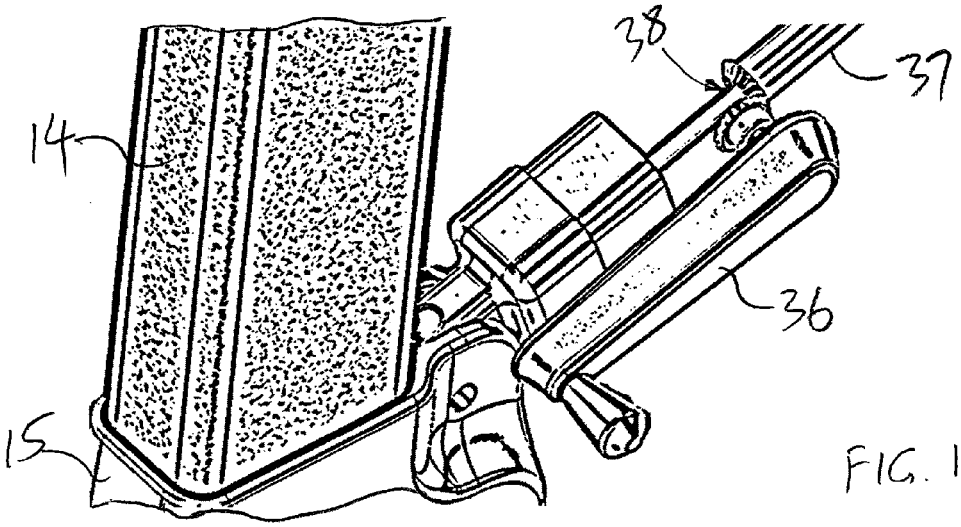
FIG. 11B is a partial open view illustrating the crank handle end of the gear drive, in accordance with one embodiment of the present invention.

In one embodiment, the pivot joint 30 is structured to freely rotate about its axis 28 when the canopy 20 is manipulated by a user (e.g., turning the canopy about the joint axis 28) to pivot or tilt the canopy to a desired orientation. In the illustrated embodiment, to facilitate user rotation of the canopy 20, the rotation of the pivot joint 30 is facilitated by a drive mechanism. As more clearly shown in FIG. 5, the drive mechanism comprises gears, such as an arrangement of a circular rack gear 34 and a pinion gear 35 at the top of the pivot joint 30. Other types of drive mechanisms (e.g., worm gears, as in other embodiments discussed below) may be provided without departing from the scope and spirit of the present invention. For example, the drive mechanism could be implemented by a system comprising shafts, pulleys, belts, chains and/or cables, etc., in alternative or in addition to gears (see, e.g., FIG. 11A). The drive mechanism thus provides a tool to provide leverage for facilitating a user to manually actuate the drive mechanism to rotate the pivot joint 30. This tool may be in the form of a crank handle, a lever, a dial pad, or other structures that facilitates rotation of gears and/or drive shaft. Referring also to FIG. 6, the tool includes a crank handle 36 coupled to a drive shaft 37 by a bevel gear drive 38 at the adjacent end of the drive shaft 37. The drive shaft 37 is rotatably supported within hollow arm 16. The other distal end of the drive shaft 37 supports the pinion gear 35 that drives the rack gear 34 to rotate the pivot joint 30 (FIG. 5). By the user turning the crank handle 36, the pivot joint 30 is rotated, as is more clearly shown in FIGS. 7A-7C. In the alternative or in addition, though not shown, the drive mechanism may be actuated by a motor drive, or a combination of manual drive and motor drive, replacing the crank handle 36.

Further, a drawstring may be provided to connect to the runner 23 of the canopy frame 24, to facilitate opening and closing of the canopy 20. Such drawstring is not specifically shown in the illustrated embodiment, but may be similar in structure to the embodiments discussed below.

Figure 9A:
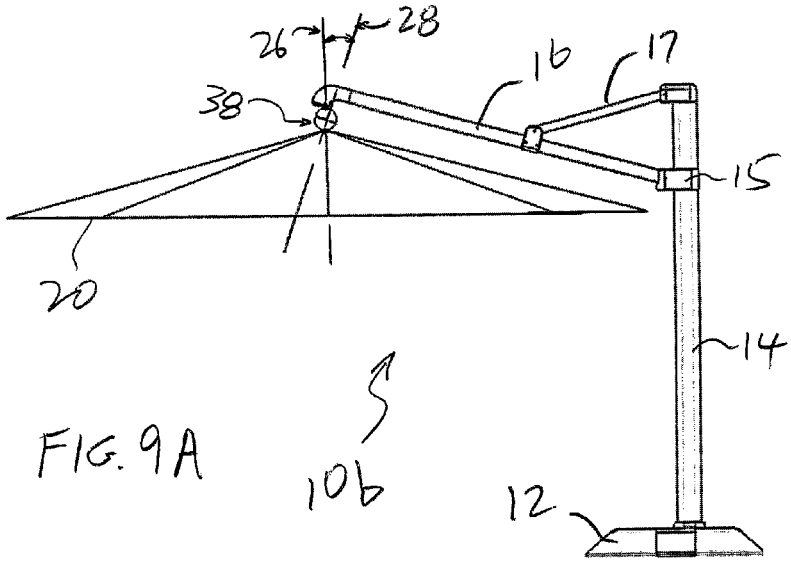
FIGS. 9A-9D illustrate orientations of a patio umbrella having a pivot joint in accordance with another embodiment of the present invention.
Figure 9B:
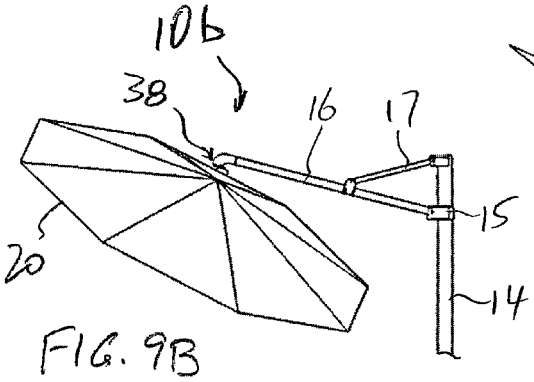
Figure 9C:
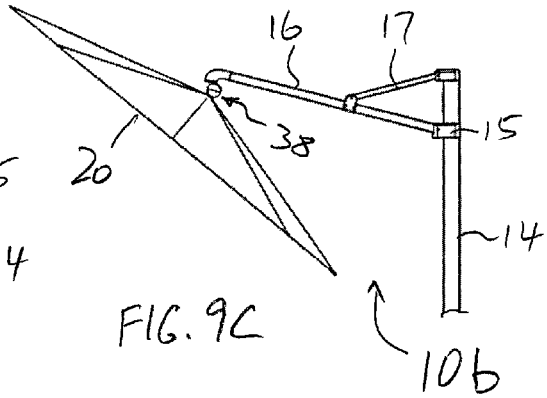
Figure 9D:
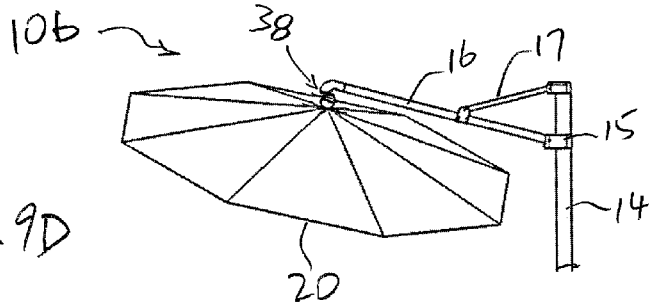

FIGS. 9A-9D illustrate orientations of a patio umbrella 10*b* having a pivot joint in accordance with another embodiment of the present invention. The structure of the patio umbrella 10' is generally similar to the structure of the patio umbrella 10*a* in the previous embodiment, with the exception of differences pertaining to the pivot joint 38. The pivot joint 38 can be a simple ball-and-socket configuration, which is schematically illustrated in the drawings. With the ball-and-socket type pivot joint 38, it need not be confined to rotation about a particular fixed axis in reference to the supporting arm 16. The pivot joint 38 can provide swiveling about the socket, thus allowing for a larger range of orientations of the canopy 20. Instead of manual rotation of the canopy 20 about the pivot joint 38, a similar gear drive mechanism may be provided to rotate the ball in the pivot joint 38, though this would limit the pivot joint 38 to rotation about a fixed axis 28 with respect to the canopy support hub axis 26, as shown in FIG. 9A.

Figure 10A:
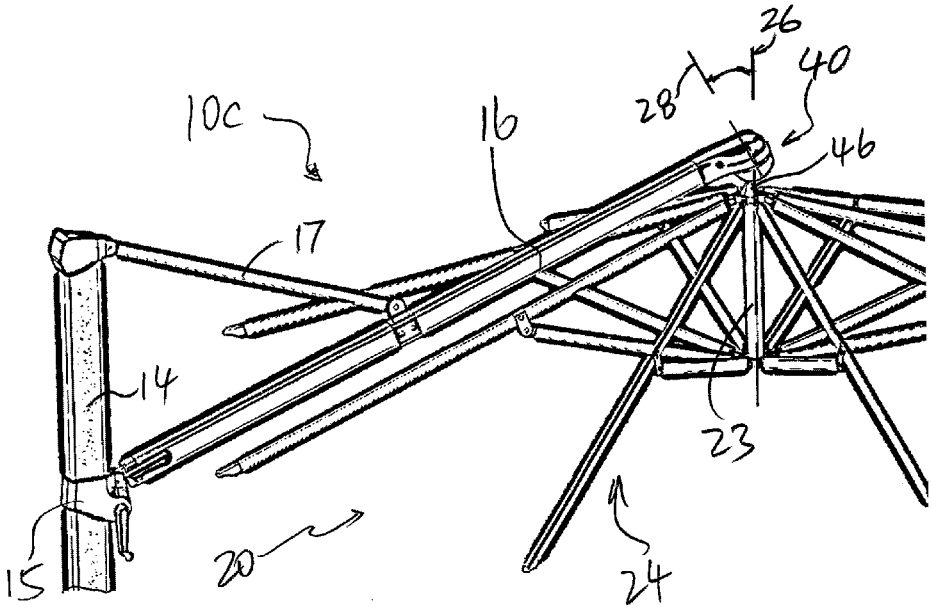
FIGS. 10A-10B illustrate a patio umbrella having a pivot joint in accordance with a further embodiment of the present invention.
Figure 10B:
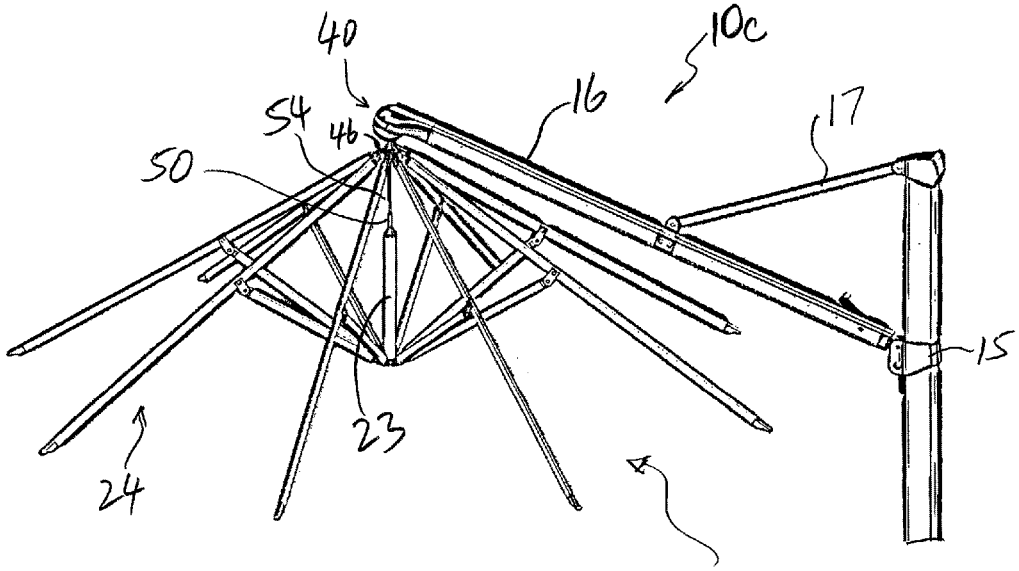

FIGS. 10A-10B illustrate a patio umbrella 10*c* having a pivot joint in accordance with a further embodiment of the present invention. The structure of the patio umbrella 10*c* is generally similar to the structure of the patio umbrella 10*a* and/or 10*b* in the previous embodiments, with the exception of differences pertaining to the pivot joint 40 illustrated in FIGS. 11A-B and FIGS. 12A-12C. This embodiment improves on the structure of the pivot joint 30 in the previous embodiment, as it further includes a disengageable anchor coupling 42 between the support hub of the canopy 20 and the pivot joint 40. This anchor coupling 42 provides more flexibility to allow the canopy support hub to be rotated towards the arm 16 when the canopy 20 is in the closed state, so as to facilitate stowing the canopy when it is not being used.

Figure 12A:
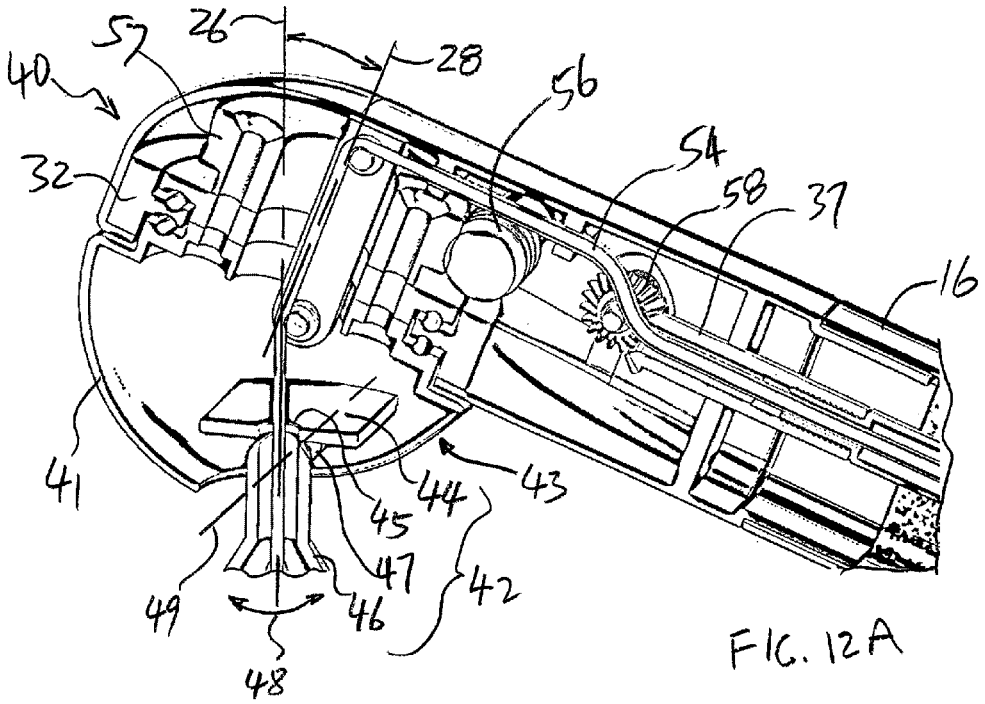
FIGS. 12A-12B are sectional views illustrating the pivot joint of the embodiment of FIG. 10.
Figure 12B:
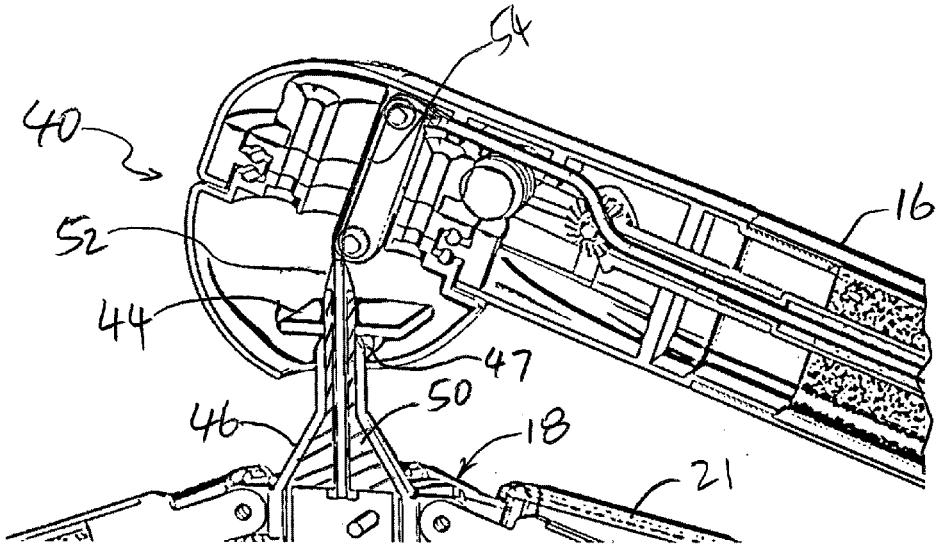
Figure 12C:
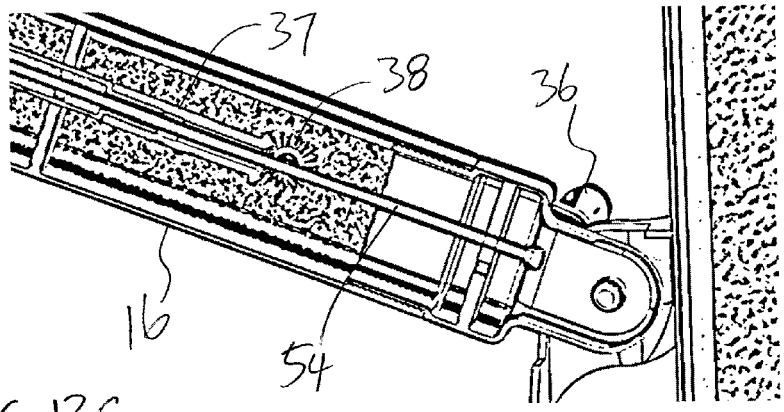
FIG. 12C is a sectional view illustrating the crank handle end of the gear drive, in accordance with one embodiment of the present invention.
Figure 13A:
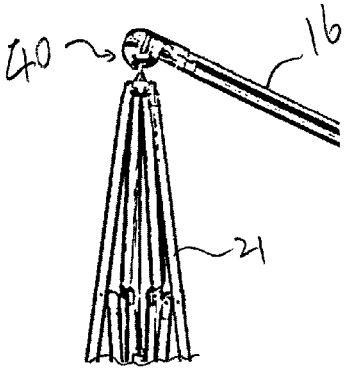
FIGS. 13A-13C illustrate the sequence of opening of the canopy of the embodiment of FIG. 10.
Figure 13B:
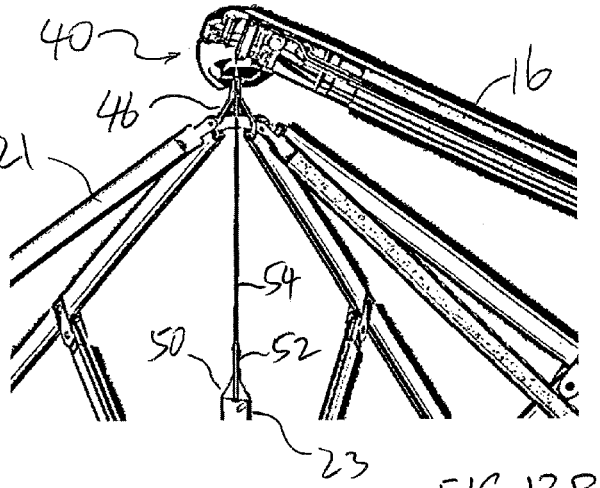

Referring to FIGS. 12A and 12B, the pivot joint 40 (comprising the gear 57 fixedly connected to the shell 41) is rotatable about the axis 28, with supporting bearings 32 within the housing 31. Specifically, the gear 57 and the shell 41 of the pivot joint 40 is rotatable on the bearings 32, with respect to the base of the pivot joint attached to the side arm 16. FIG. 12A shows the state of the anchor coupling 42 when the canopy 20 is in the fully closed or partially opened/closed position (i.e., corresponding to the states illustrated in FIGS. 10B, 13A and 13B). The anchor coupling 42 comprises an anchor support 44 and an anchor guide 46, and a disengageable anchor 50. In the illustrated embodiment, the anchor support 44 is securely attached to the pivot joint 40 (e.g., fixedly attached to the shell 41), in the form of a plate having an opening 45. The anchor guide 46 is partially shown in FIGS. 12A and 12B, but fully shown in FIGS. 12B, 13B and 13C. The anchor guide 46 connects to or may be part of the crown 18 of the canopy 20. The long ribs 21 of the canopy frame 24 may be pivotally connected to the anchor guide 46, as illustrated. The anchor guide 46 is pivotally supported by at a horizontal hinge 47 that is supported by the pivot joint 40 (e.g., by the shell 41), so that the anchor guide 46 can pivot/swing along arc 48 about the axis 49 of the hinge 47 (i.e., towards and away from the arm 16). The generally hemispherical shell 41 is provided with appropriate cutout 43 to allow for the pivotal movements of the anchor guide 46. The anchor guide 46 has a hollow interior cavity, which is sized and shaped to receive a matching anchor 50 that is complementarily sized and shaped (as shown in FIG. 12B).

Figure 13C:
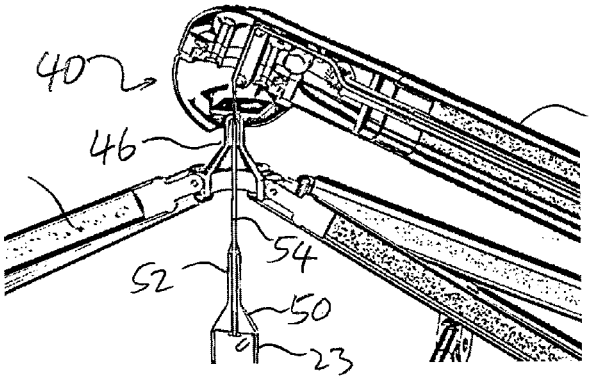

Referring also to FIGS. 10B and 13C, the anchor 50 is attached to the top end of the central canopy support hub or runner 23. FIG. 12B illustrates the state of the anchor coupling 42 when the canopy 20 is fully opened. The anchor 50 is received in the anchor guide 46, with the extended anchor pin 52 of the anchor 50 inserted through the end of the anchor guide 46, and into the opening 45 in the anchor support 44. A drawstring connects to the anchor 50. Referring to FIGS. 10B, 13A to 13C, by pulling on the drawstring 54, the runner 23 is raised to open the canopy frame 24, thereby engaging the anchor pin 52 against the anchor support 44. More specifically, in operation, as the drawstring 54 is pulled upwards to raise the runner 23, it pivots the short ribs 22 to spread the long ribs 23 in the canopy frame 24, thereby opening the frame 24 and thus the shades 25 of the canopy 20. At the same time, the anchor pin 52 is received in the opening in the anchor support 44, thereby engaging the anchor pin 52 to the anchor support 44. The anchor guide 46 essentially guides the anchor pin 52 to engage the opening 45 in the anchor support 44. When the anchor pin 52 engages the anchor support 44, it locks the anchor guide 46 to prevent it from rotation about the hinge 47, thus preventing the canopy 20 from rocking (pivotal) movement about the hinge 47 when the canopy 20 is fully extended in use (e.g., when the wind blows). As the drawstring 54 is released to lower the runner 23, the short ribs 22 are pivoted to collapse the long ribs 21, thereby closing/collapsing the canopy frame 24 and thus the shade 25. In this embodiment, the canopy support hub includes the crown 18, which defines the canopy support hub axis 26 (which shares the same axis as the anchor pin 52, anchor support 44, and the runner 23).

In this embodiment, given engagement of the anchor pin 52 to the anchor support 44, when the pivot joint 40 rotates (i.e., by rotating the anchor support 44 with rotation of the shell 41 and gear 57), the canopy 20 rotates along with the pivot joint 40. However, if anchor 50 is rotatably received in the anchor guide 46, and if the drawstring is rotatably connected to the anchor 50, then the canopy 20 may freely rotate with respect to the pivot joint 40, thereby the canopy 20 does not need to rotate along with the anchor guide 50.

Figure 14A:
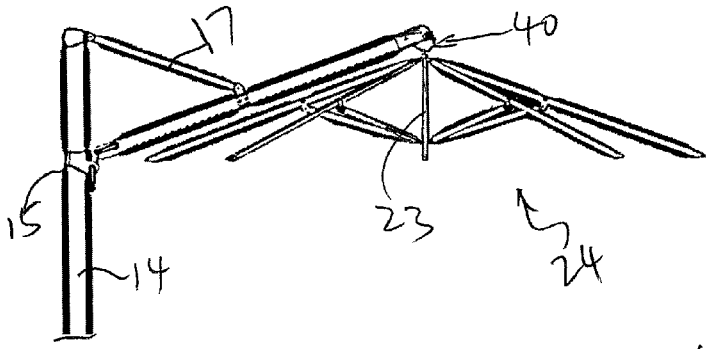
FIGS. 14A-14C illustrate orientations of the canopy frame with rotation of the pivot joint of the embodiment of FIG. 10.
Figure 14B:
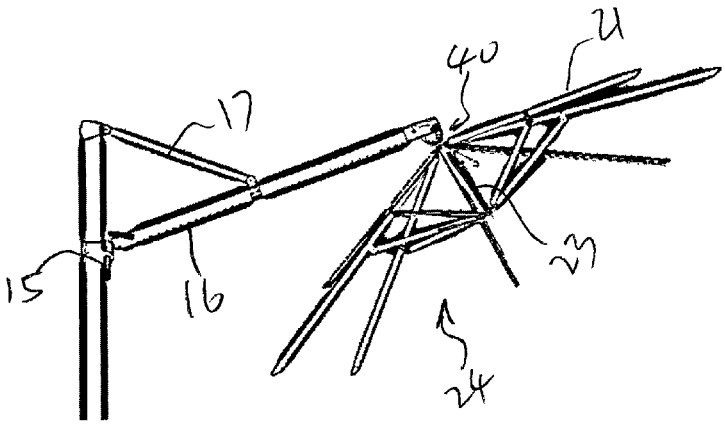
Figure 14C:
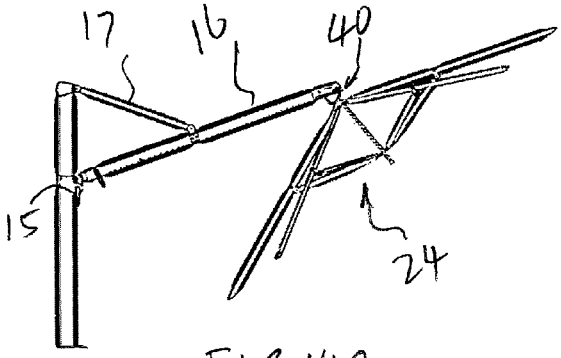
Figure 14D:
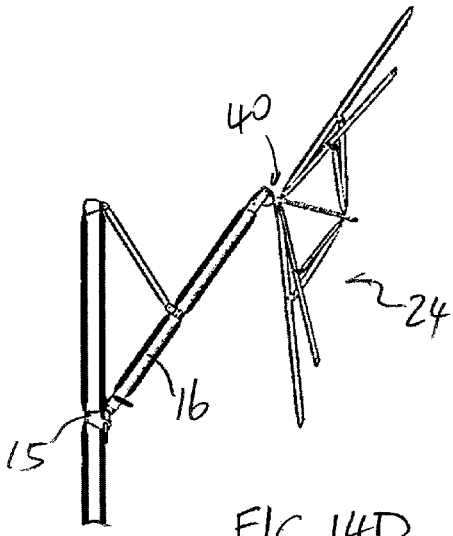
FIG. 14D illustrates further tilting of the canopy with a change of position of the cantilevered arm.

As can be appreciated from the drawings, given the fixed tilt angle between the pivot joint rotation axis 28 and the canopy support hub axis 26, as the pivot joint 30 rotates about its axis 28, the canopy 20 is rotated along with the rotation of the pivot joint 30, thus causing the canopy support hub axis 26 to tilt (in particular, the axis 26 rotates about axis 30, prescribing a path corresponding to the surface of a cone with axis 28). As a result, the canopy 20 changes its orientation with respect to the supporting arm 16. FIGS. 14A-14C illustrate orientations of the canopy frame 24 with rotation of the pivot joint 40 (the shade 25 is omitted from view, so as to more clearly show the relative position of the canopy frame 24 to the arm 16). FIG. 14D illustrates further tilting of the canopy 20 with a change of position of the cantilevered arm 16, by moving the cantilever support 15.

Accordingly, unlike the prior art configurations, the orientation of the canopy 20 in the patio umbrella 10*b* can be changed without requiring rotation of the supporting arm 16 from which the canopy 20 is supported at its extended end. Further, unlike the prior art, the orientation of the canopy 20 can vary in more than one plane and/or with more than one degree of freedom with respect to the support arm 16, given that the axis 26 can be essentially swiveled in space, not confined to movement within a particular plane. This embodiment further allows the canopy 20 to be pivoted to close to the arm 16 for storage.

In one embodiment, the pivot joint 40 is structured to freely rotate about its axis 28 when the canopy 20 is manipulated by a user (e.g., turning the canopy about the joint axis 28) to pivot or tilt the canopy to a desired orientation. In the illustrated embodiment, to facilitate user rotation of the canopy 20, the rotation of the pivot joint 40 is facilitated by a drive mechanism, which may take a structure similar to that shown in FIG. 5. However, it is desirable to provide a drive mechanism to resist undesired rotation of the pivot joint with respect to its housing (e.g., by strong winds or a person). For example, the drive mechanism would be structured to be self-locking, e.g., using worm gear drive, such that the joint cannot be easily rotated under strong winds or by the user turning the canopy. Alternatively, a separate locking mechanism may be provided to securely lock the pivot joint in place at a desired rotated position (whether or not there is a gear drive mechanism) with respect to the joint housing, so as to secure the canopy in the desired tilted position. For example, indexing keys, locking pin and groove/hole mechanism, etc. may be provided for the pivot joint and its housing.

Referring to the embodiment illustrated in FIGS. 11A-B and 12A-C, the pivot joint 40 is coupled to the extended end of a drive shaft 37 by a system of drive gears and belts, which provides a drive mechanism having a desired gear ratio and improved integrity, stability and durability. In this embodiment, the drive mechanism includes a worm drive (e.g., a worm 56 and a worm gear/wheel 57 connected to the rotatable pivot joint 40) that rotates the rotatable pivot joint 40, a bevel gear drive at the end of the drive shaft 37, and a belt 59 coupling the rotation of the bevel gear drive 58 to the worm 56 of the worm drive. The drive shaft 37 is hollow, through which the drawstring 54 is free to slide within. In the illustrated embodiment, as noted above, the end of the drawstring 54 at the joint pivot 40 is coupled to the anchor 50 at the top of the runner 23. (It is noted that the drawstring structure of this embodiment may be adapted and applied to the previous embodiment, with the drawstring 54 attached to the top of the runner 23 without the anchor 50.)

The other end of the drawstring 54 is coupled to a lever or handle 36 near the sliding cantilever support 15, similar to the previous embodiment. The drive mechanism thus provides a tool to provide leverage for facilitating a user to manually actuate the drive mechanism to rotate the pivot joint 40. In the alternative or in addition, though not shown, the drive mechanism may be actuated by a motor drive, or a combination of manual drive and motor drive, replacing the crank handle 36.

In another embodiment, the canopy support hub makes a variable tilt angle with respect to the pivot joint rotation axis. The canopy may or may not rotate along with the rotation of the pivot joint. As a result of the variable tilt angle between the pivot joint rotation axis and the canopy support hub axis. The rotation of the pivot joint causes tilting of the canopy support hub axis, thus tilting the canopy to change its orientation.

Figure 15A:
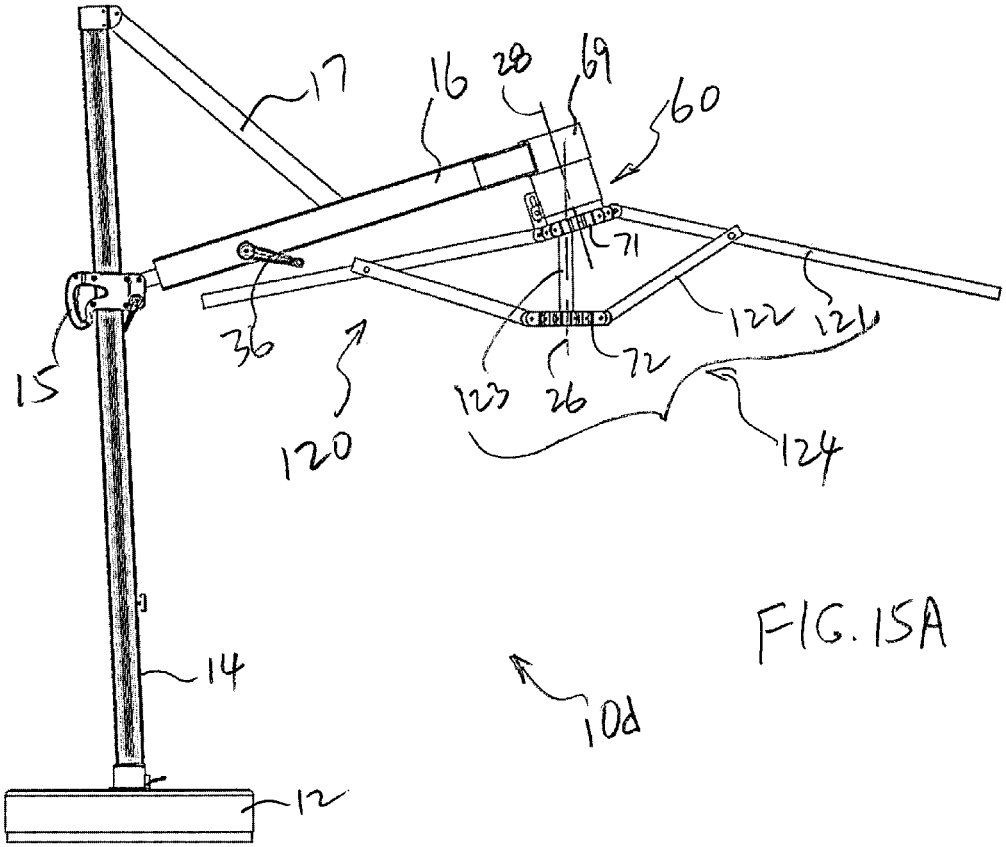
FIG. 15A is a schematic side view illustrating a patio umbrella having a pivot joint in accordance with a still further embodiment of the present invention.
Figure 15B:
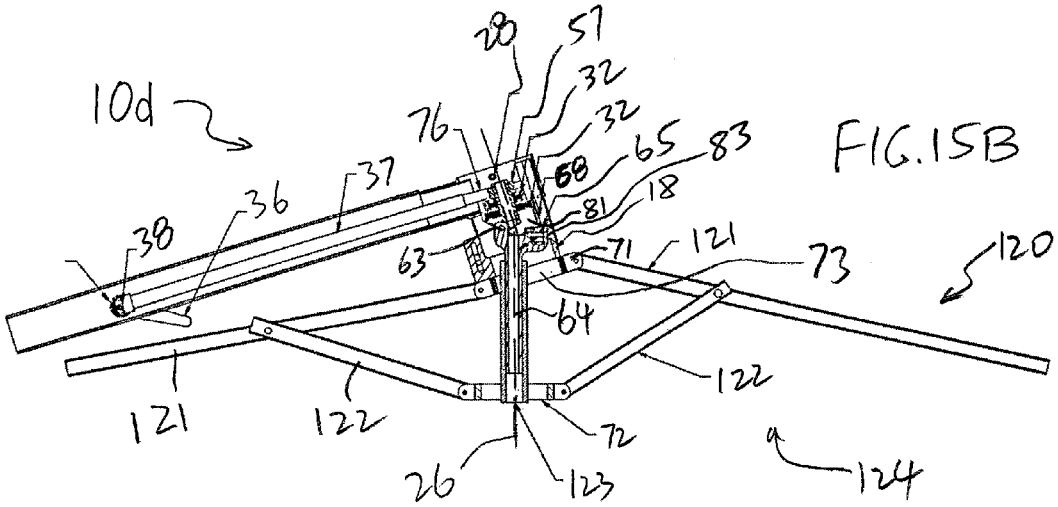
FIG. 15B is a schematic sectional view of the canopy of FIG. 15A.
Figure 15C:
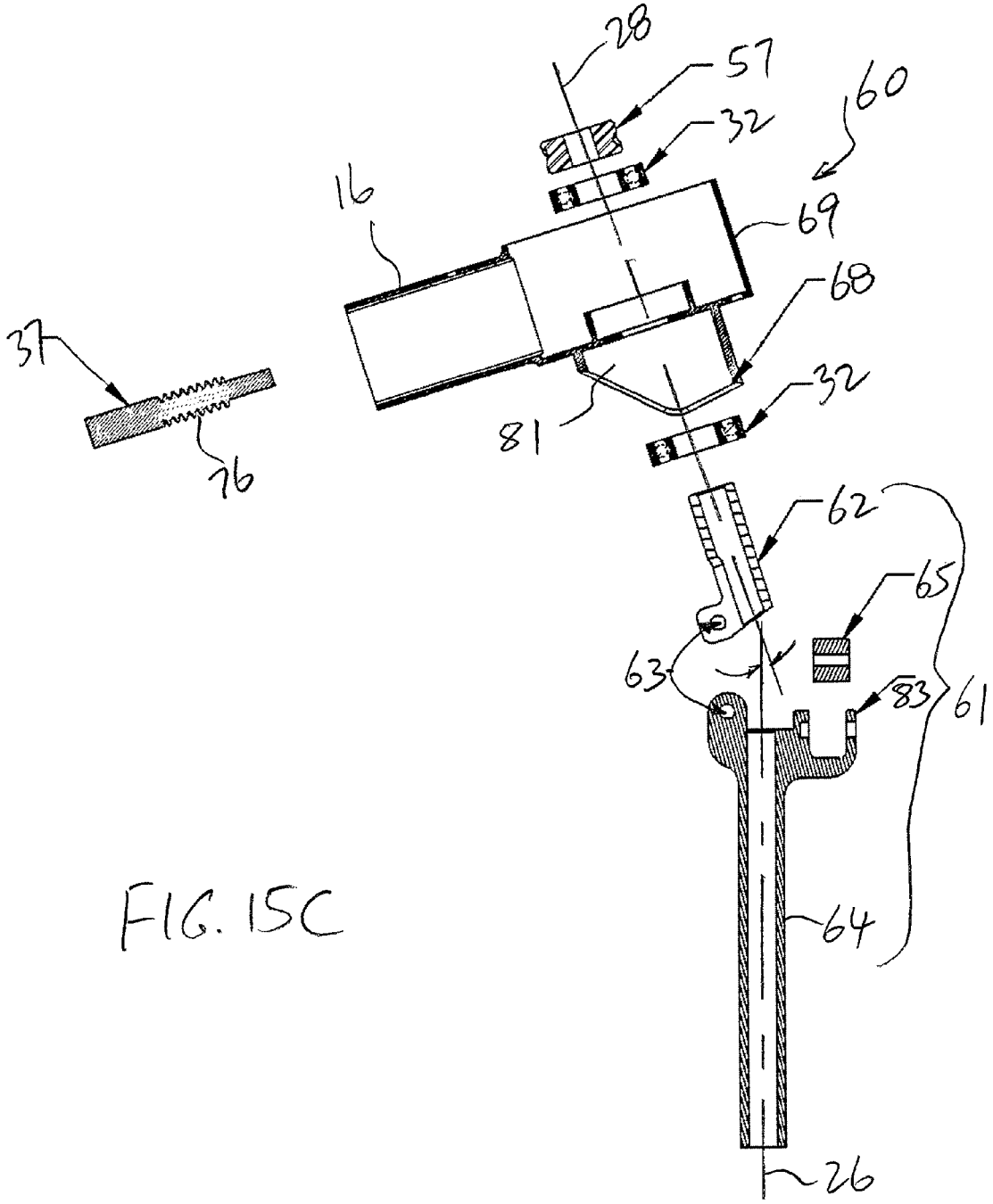
FIG. 15C is an exploded schematic sectional view of the pivot joint of FIG. 15B.

FIGS. 15A-15C schematically illustrates a patio umbrella 10*d* having a pivot joint rotation axis 28 at variable tilt angle to the canopy support hub axis 26, in accordance with an embodiment of the present invention. The structure of the patio umbrella 10*d* is generally similar to the structure of the patio umbrella 10*a* to 10*c* in the previous embodiments, with the exception of differences pertaining to the pivot joint 60 and the canopy frame 124 illustrated in FIGS. 15A-15C (the shade 25 is omitted from view, so as to more clearly illustrate the shape of the canopy frame 124). As illustrated, the rotatable pivot joint 60 is coupled to a canopy 120 via a variable tilt angle interface structure that comprises a flex joint axle 61, which includes a rotatable joint axle 62 that rotates along a fixed axis 28 at a fixed tilt angle with respect to the cantilevered arm 16, and a tilt joint axle 64. This embodiment does not require rotation of the canopy frame 124 (and hence no rotation of the canopy 120), thus less effort is required to change the orientation of the canopy 120. The canopy frame 124 is designed to be "floating" with respect to the supporting arm 16, as the overall shape and/or configuration of the canopy frame 124 can be varied by rotation of the pivot joint 60. As the canopy frame 124 changes its shape, it effectively causes the overall orientation of the canopy to change.

Within the housing 69, the rotatable joint axle 62 is supported to rotate by one or more support bearings 32 (in the illustrated embodiment, there are two bearings 32). The end of the rotatable joint axle 62 is fixedly connected to a worm gear/wheel 57, and a worm 76 at the end of a drive shaft 37 in the hollow cantilevered arm 16 rotates the worm gear 57. The configuration of gear and bearings may be similar to the earlier described embodiments. A bevel gear drive (not shown but similar to those disclosed in the earlier embodiments) is provided at the other end of the drive shaft (e.g., nearer the cantilever support 15 as in the earlier embodiments) to couple a crank handle 36 to rotate the drive shaft 67.

The tilt joint axle 64 is coaxially and slidably inserted into the runner 123, as seen in FIG. 15B. The common axis of the tilt joint axle 64 and the runner 123 is thereby the canopy support hub axis 26. The tilt joint axle 64 is hingedly/pivotally attached to the rotatable joint axle 62 at hinge point 63, thereby the tilt angle between the canopy support hub axis 26 and the rotatable joint axle axis (which defines the pivot joint axis 28 in this embodiment) can vary. In essence, the variable angle interface structure resembles a universal joint, or a flex joint coupling the pivot joint 60 to the canopy 120.

A cam follower in the form or a roller 65 is provided at the side support 83 at the end of the tilt joint axle 64, in operative engagement with a cam surface 68 defined at the edge or perimeter of a cylinder 81 that is coaxial with the rotatable joint axle 62 and fixedly supported by the pivot joint 60. The profile of the cam surface 68 can be better seen in a similar cam surface 68 in the embodiment of FIG. 16B. The cam surface 68 is configured with a continuous series of slanted surfaces about the rotatable joint axle 62. The slanted surfaces 68 may be a combination of discrete surface sections at various angles with respect to the cam follower roller 65, or continuous smoothly varying cam surface sections.

The crown 18 of the canopy is fixedly coupled to the base or housing of pivot joint 60. The long ribs 121 are pivotally connected to an upper collar 71 that is fixedly attached to the base of the crown 18. The upper collar 71 defines a central space 73 that allows the runner 123 to sway within that space. The short ribs 122 are pivotally connected to a lower collar 72 fixedly attached to the lower end of the runner 123. With this structure of the canopy frame 124, the canopy frame acquires a "floating" configuration, as the entire frame 124 can flex and take a shape depending on the tilt angle of flex joint axle 61 and the sway of the runner 23. As is clear from FIG. 15B, the top end of the runner 123 floats within the space of the upper collar 71. In this embodiment, the canopy support hub comprises the lower collar 72, which defines the canopy support hub axis 26. The upper collar 71, however, does not tilt with rotation of the pivot joint 60.

As the user rotates the crank handle 36 to rotate the drive shaft 37, the worm gear causes rotation of the rotatable joint axle 62, thus rotating the tilt joint axle 64. Given the flex joint axle 61 is not attached to the crown 18, and the crown 18 is fixedly supported and does not rotate with the rotation of the flex joint axle 61, when the follower roller 65 rolls against and follows the profile of the cam surface 68, the tilt angle of the tilt joint axle 64 is varied with respect to the rotatable joint axle 62. The cam follower roller 65 rolls against the cam surface 68, thus varying the tilt of the canopy support hub axis 26 with respect to the pivot joint axis 28. This causes the runner 123 to sway, to thereby vary the configuration and/or shape of the canopy frame 124. As shown in the drawings, the long ribs 121 and the short ribs 122 articulates as the tilt joint axle is being tilted, thus causing the runner 123 to sway sideways (without the canopy rotating on its axis). As a result, the overall canopy 120 sways to tilt the canopy 120 to face different directions as desired. Consequently, the orientation of the canopy 120 varies accordingly, thereby facing different directions as desired by the user. Generally, the canopy 120 is generally facing the direction at which the longitudinal axis of the runner 123 (or the canopy support hub axis 26) is pointed. This embodiment is particularly advantageous for large canopy, as rotation of a large, heavy canopy would require more effort by a user. With this embodiment, the desired orientation of the canopy can be achieved with the need to rotate the canopy to tilt the canopy. Reference is made to FIGS. 17A-17J, which illustrate a slightly modified embodiment of a flex joint axle 64, but nonetheless illustrate the variation in the tilt angle of the tilt joint axle 64 as the flex joint axle 61 of the pivot joint 60 rotates, as will be further elaborated below.

In this embodiment, the rotatable joint axle 62 and the tilt joint axle 64 are hollow, and a drawstring can run through such hollow axles to connect to the bottom of the runner 123 (or lower collar 72) to allow lowering or raising the runner 123 with respect to the crown 18, in a manner similar to the drawstring 54 described in the earlier embodiments. The runner 123 telescopes over the tilt joint axle 64, wherein lowering and raising of the runner 123 in reference to the tilt joint axle 64 would operate to open and close the canopy 120 (in a similar fashion as in the earlier embodiment).

Figure 16A:
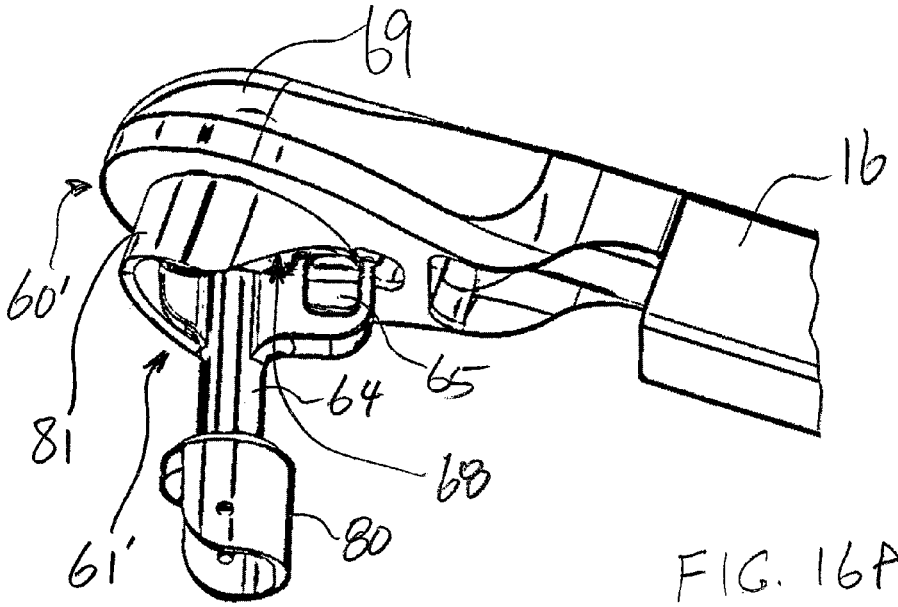
FIG. 16A is a perspective view illustrating a pivot joint in accordance with yet another embodiment of the present invention.
Figure 16B:
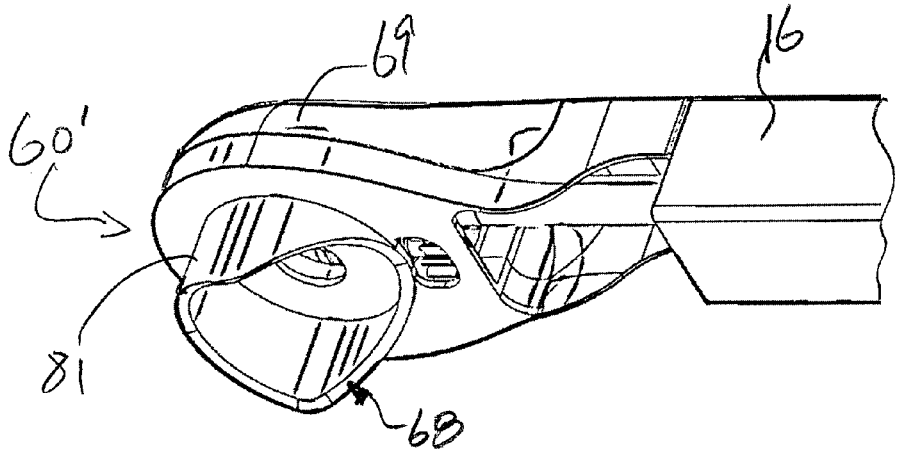
FIG. 16B is a perspective view of the cam structure in the pivot joint of FIG. 16A.
Figure 17A:
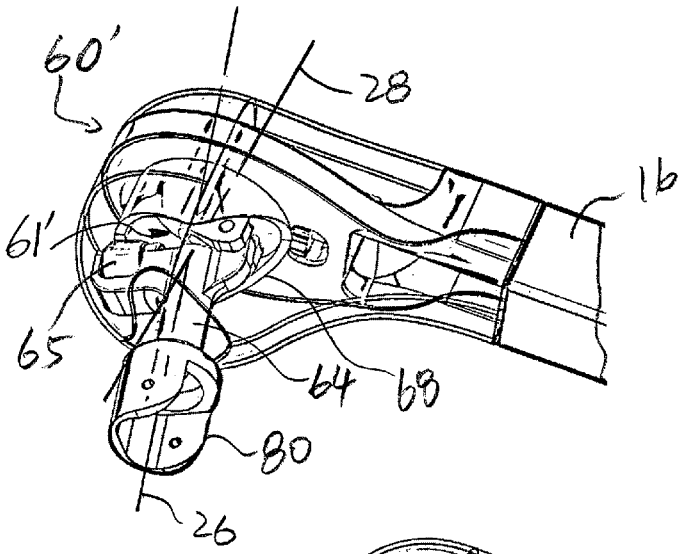
FIGS. 17A-17J illustrate the angles of a tilt joint axle with rotation of the flex joint axle of the pivot joint in FIG. 16.
Figure 17B:
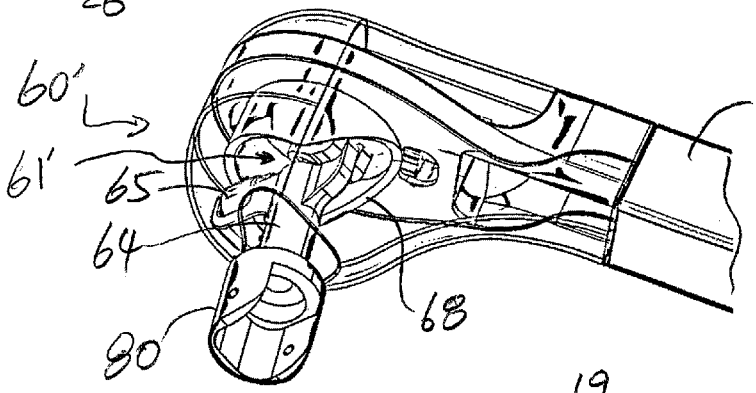
Figure 17C:
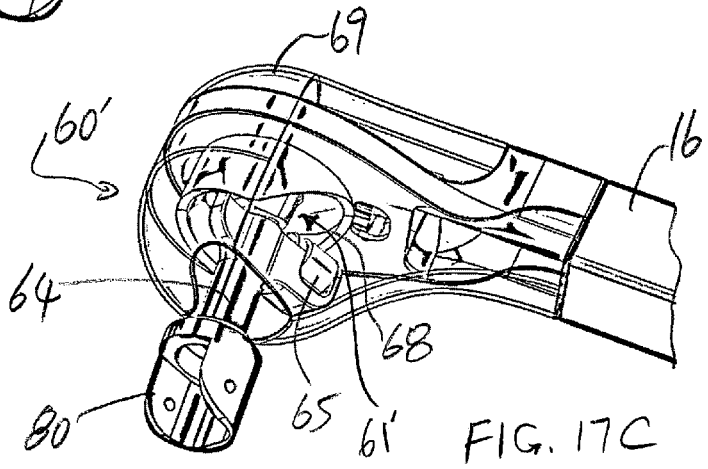
Figure 17D:
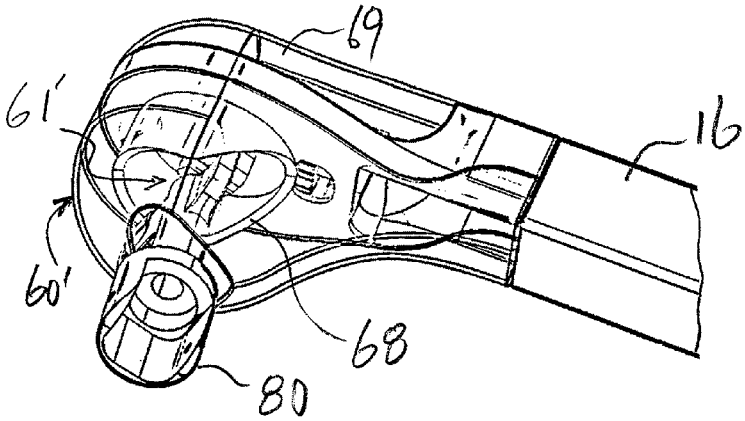
Figure 17E:
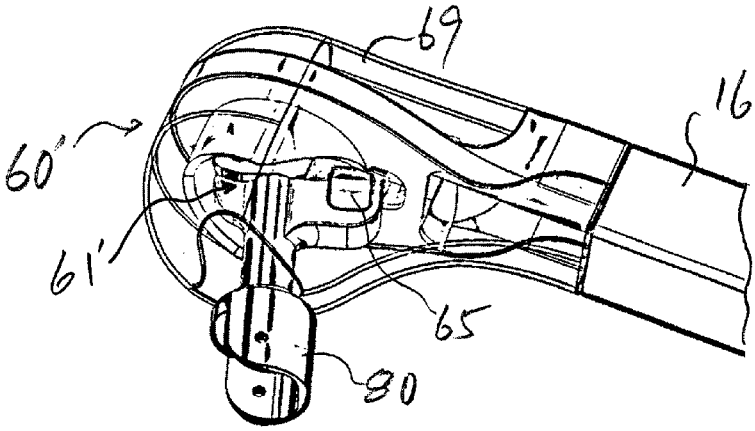
Figure 17F:
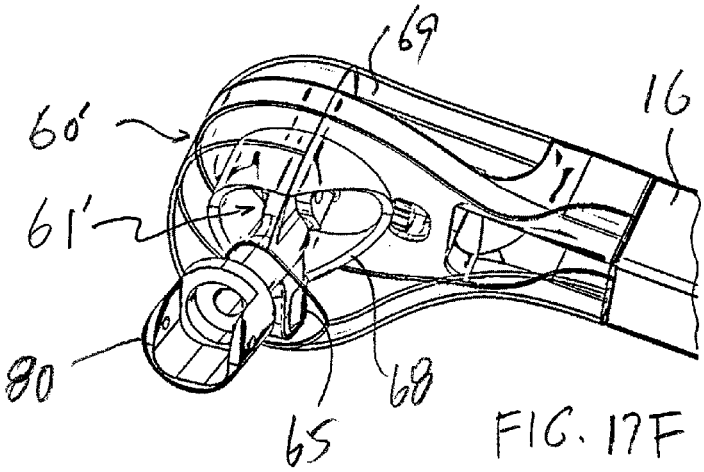
Figure 17G:
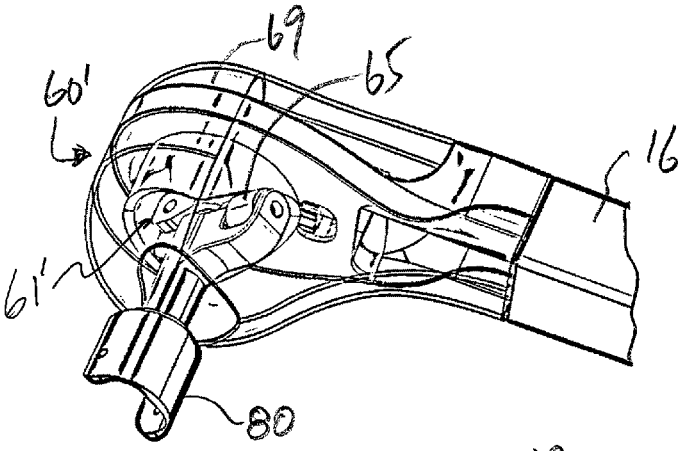
Figure 17H:
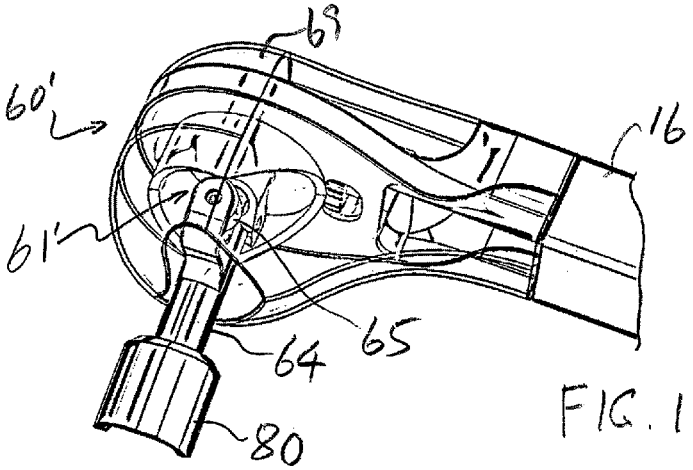
Figure 17I:
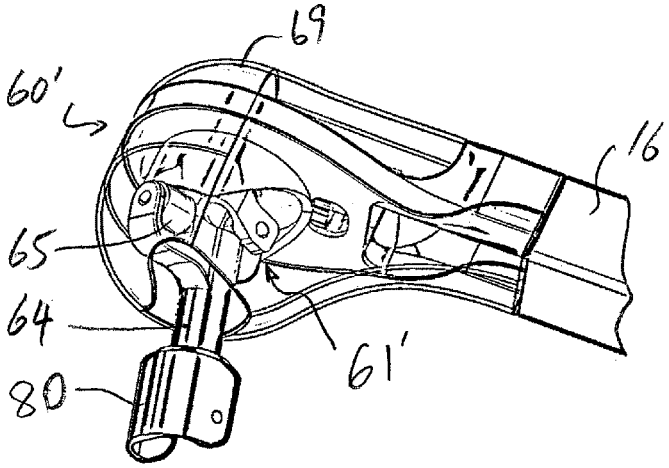
Figure 17J:
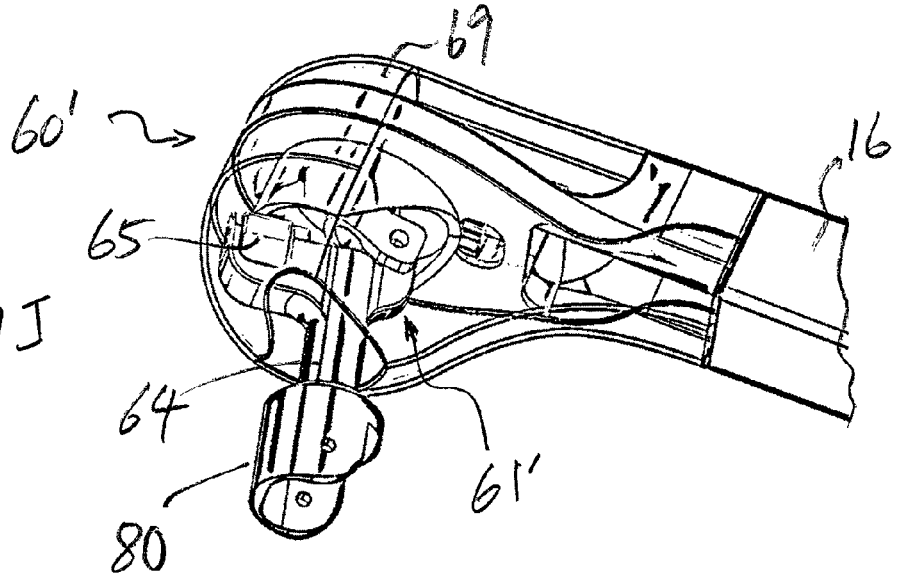

FIGS. 16A and 16B illustrate a pivot joint 60' modified from the pivot joint 60 in the previous embodiment in accordance with yet another embodiment of the present invention. This embodiment is quite similar to the previous embodiment of FIG. 15, with a flex joint axle 61' that is similar to the flex joint axle 61 in the previous embodiment, except that the tilt joint axle 64 is fixedly connected to the crown of the canopy 20 in this embodiment, so as to rotate the canopy 20 when the flex joint axle rotates (canopy 20 not shown, but can be similar in structure to those illustrated in the earlier embodiments, e.g., FIGS. 1 and 10). In this embodiment, the only modification is to the tilt joint axle 64. Specifically, the extended end of the tilt joint axle 64 is provided with a coupling 80 for affixing to the crown 18 of the canopy 20.

FIGS. 17A-17J illustrate variation in the tilt angle between the tilt joint axle 64 (i.e., the canopy support hub axis 26) and the rotatable joint axle 62 (i.e., the pivot joint rotation axis 28) with rotation of the flex joint axle in the pivot joint 60'.

For all the above described embodiments, the extent of the tilt angle between the canopy support hub and the pivot joint rotation axis in the pivot joint depends on one or more of the following considerations: size of the canopy, extent of the opening of the canopy, weight of the canopy, range of orientations of the canopy (i.e., the range of directions of the support hub axis), orientation of the pivot joint rotation axis with respect to the supporting structure (e.g., the side arm to which the pivot joint is supported), position of the side arm, and/or desired application of the umbrella. Generally, such tilt angle can be less than greater than 0 degrees to about 45 degrees.

In the drawings, some of the components (such as the canopy, crown, drawstrings, etc.) are not specifically shown and/or, but they are similar in structure to the corresponding components specifically described and/or illustrated in connection with other embodiments.

****

While the present invention has been described above in connection with the illustrated embodiments, the scope of patent invention covers all possible present and future variations and improvements that is apparent from the disclosure above. While the invention has been particularly shown and described with reference to the preferred embodiments, it will be understood by those skilled in the art that various changes in form and detail may be made without departing from the spirit, scope, and teaching of the invention. Accordingly, the disclosed invention is to be considered merely as illustrative and limited in scope only as specified in the appended claims.

The invention claimed is:

1. An umbrella, comprising:

a support structure, wherein the support structure comprises an arm having an extended end, and wherein the arm has a longitudinal arm axis;

a canopy defining a first axis, wherein the canopy is coupled to the extended end of the arm;

a pivot joint coupling the canopy to the support structure, wherein the pivot joint is rotatable with respect to the support structure, about a second axis at a tilt angle with respect to the first axis, and wherein the second axis is at a non-zero angle to the arm axis at the extended end, wherein orientation of the canopy can be changed with respect to the support structure by rotating the pivot joint.

2. The umbrella as in claim 1, wherein the canopy comprises a frame including a hub defining the first axis, wherein the hub is coupled to the pivot joint.

3. The umbrella as in claim 1, wherein the tilt angle is fixed.

4. The umbrella as in claim 3, wherein the canopy rotates with rotation of the pivot joint.

5. The umbrella as in claim 1, wherein the tilt angle is variable as the pivot joint is rotated with respect to the support structure about the second axis.

6. The umbrella as in claim 5, wherein the canopy does not rotate about the first axis with rotation of the pivot joint about the second axis.

7. The umbrella as in claim 1, wherein the orientation of the canopy can be changed in more than one plane.

8. The umbrella as in claim 1, wherein the orientation of the canopy can be changed with more than one degree of freedom.

9. The umbrella as in claim 1, wherein the orientation of the canopy can be changed without rotation of the support structure.

10. The umbrella as in claim 1, wherein the pivot joint comprises a fixed cylinder rotatable about the second axis, and wherein the fixed cylinder is coupled to the canopy via a wedge-shape interface structure to define the tilt angle that is fixed for the first axis.

11. The umbrella as in claim 1, wherein the pivot joint comprises a disengageable anchor coupling.

12. The umbrella as in claim 11, wherein the disengagement anchor coupling comprises an anchor support that is rotatable with respect to the support structure about the second axis, and an anchor engageable with the anchor support defining the first axis, wherein the anchor is connected to the canopy.

13. The umbrella as in claim 12, wherein the anchor coupling further comprises an anchor guide, guiding engagement of the anchor to the anchor support.

14. The umbrella as in claim 13, wherein the anchor comprises an extended anchor pin that engages with a complementary opening in the anchor support.

15. The umbrella as in claim 1, wherein the pivot joint comprise a flex joint axle, which varies the tilt angle as the pivot joint rotates.

16. The umbrella as in claim 15, wherein the flex joint axle comprises a tilt joint axle pivotally connected to a rotatable joint axle, wherein the rotatable joint axle is supported for rotation with respect to the support structure about the second axis, and the tilt joint axle is coupled to the canopy and rotates about the first axis with the rotation of the rotatable joint axle.

17. The umbrella as in claim 16, wherein the flex joint axle further comprises a cam surface fixedly coupled to the support structure and a cam follower coupled to the tilt joint axle, and wherein with the rotation of the tilt joint axis causes the cam follower to follow profile of the cam surface, which tilts the first axis at varying tilt angles, thereby tilting the canopy to face different orientations.

18. The umbrella as in claim 17, wherein the canopy does not rotate about the first axis with rotation of the pivot joint about the second axis.

19. The umbrella as in claim 17, wherein the canopy is connected to the tilt joint axle for rotation therewith.

* * * * *